US010603930B2

(12) United States Patent
Tojino et al.

(10) Patent No.: US 10,603,930 B2
(45) Date of Patent: Mar. 31, 2020

(54) RECORDING METHOD AND RECORDING APPARATUS

(71) Applicant: Seiko Epson Corporation, Tokyo (JP)

(72) Inventors: Mami Tojino, Shiojiri (JP); Ippei Okuda, Shiojiri (JP); Akira Mizutani, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/174,555

(22) Filed: Oct. 30, 2018

(65) Prior Publication Data

US 2019/0126640 A1 May 2, 2019

(30) Foreign Application Priority Data

Oct. 31, 2017 (JP) ..... 2017-210845
Aug. 3, 2018 (JP) ..... 2018-146363

(51) Int. Cl.
*B41J 11/00* (2006.01)
*B41M 5/00* (2006.01)

(52) U.S. Cl.
CPC ..... *B41J 11/002* (2013.01); *B41M 5/0011* (2013.01); *B41M 5/0017* (2013.01)

(58) Field of Classification Search
CPC .. B41J 11/002; B41M 5/0017; B41M 5/0011; C09D 11/40; C09D 11/107; C09D 11/54; C09D 11/322
USPC ..... 347/95, 100; 106/31.13, 31.51
See application file for complete search history.

(56) References Cited

U.S. PATENT DOCUMENTS 9,109,129 B2 * 8/2015 Goto ..... C09D 11/30
9,278,527 B2 * 3/2016 Aratani ..... B41J 2/1433
2019/0100048 A1 * 4/2019 Ohta ..... B41J 11/0015

FOREIGN PATENT DOCUMENTS

JP 2017-014389 A 1/2017

* cited by examiner

*Primary Examiner* — An H Do
(74) *Attorney, Agent, or Firm* — Harness, Dickey & Pierce, P.L.C.

(57) ABSTRACT

A recording method includes heating a recording medium and attaching an ink composition including an organic solvent and water to the heated recording medium by performing a main scanning a plurality of times. In each main scanning the ink composition is ejected from a recording head while a position of the recording head relative to the recording medium in a main scanning direction is changed. In the ink composition, an absolute value of a difference between a surface tension of the ink composition and a surface tension of the ink composition when the ink composition is evaporated up to an evaporation amount of 0% to 40% by mass is 1 mN/m or less.

20 Claims, 3 Drawing Sheets

RECORDING METHOD AND RECORDING APPARATUS

BACKGROUND

1. Technical Field

The present invention relates to a recording method and a recording apparatus.

2. Related Art

Ink jet recording methods are capable of recording high-definition images with a relatively simple apparatus and are undergoing rapid development in various respects. These include various investigations being carried out regarding obtaining higher quality recorded matters in a more stable manner.

For example, with an object of providing an ink jet ink composition which is excellent in storage stability and ejection stability as well as being capable of obtaining recorded matters that have excellent abrasion resistance, JP-A-2017-14389 discloses an ink jet ink composition including water, a solvent, a resin having a core-shell structure, and a monomer component, in which a Solubility Parameter value (A) of the solvent and a Solubility Parameter value (B) of the monomer component have a predetermined relationship and the content of the monomer component is a predetermined amount or less with respect to the total amount of the ink jet ink composition.

In a recording method using an ink composition such as that disclosed in JP-A-2017-14389, in cases where a recording medium is heated and then a main scanning process, in which the ink composition is ejected from the recording head and attached to the recording medium while the position of the recording head relative to the recording medium is changed in the main scanning direction, is performed a plurality of times, or in cases where a so-called serial recording method or a multi-pass recording method is used, color differences may be generated in which there are differences in the colors despite the recording being carried out in the same manner.

SUMMARY

An advantage of some aspects of the invention is to provide a recording method capable of obtaining recorded matters that are excellent in image quality and excellent in color difference reduction.

As a result of intensive investigations to solve the above-described problems, the present inventors found that it is possible to obtain recorded matters that are excellent in image quality and excellent in color difference reduction using a recording method including heating a recording medium and attaching an ink composition including an organic solvent and water to the heated recording medium by performing a main scanning, in which the ink composition is ejected from a recording head while a position of the recording head relative to the recording medium in a main scanning direction is changed, a plurality of times, in which, in the ink composition, an absolute value of a difference between a surface tension of the ink composition and a surface tension of the ink composition when the ink composition is evaporated up to an evaporation amount of 0% to 40% by mass is a predetermined value or less.

According to an aspect of the invention, there is provided a recording method including heating a recording medium, and attaching an ink composition including an organic solvent and water to the heated recording medium by performing a main scanning, in which the ink composition is ejected from a recording head while a position of the recording head relative to the recording medium is changed in a main scanning direction, a plurality of times, in which, in the ink composition, an absolute value of a difference between a surface tension of the ink composition and a surface tension of the ink composition when the ink composition is evaporated up to an evaporation amount of 0% to 40% by mass is 1 mN/m or less.

The reasons why such a recording method is able to solve the problem of the invention are considered to be as follows. However, the reasons are not limited thereto. That is, it is not possible to obtain a recorded matter without color differences with the recording methods of the related art due to the fact that ink compositions are used in which the surface tension of the ink composition changes greatly when a predetermined amount of the ink composition being used is evaporated in comparison with the surface tension of the ink composition before the evaporation. On the other hand, in the recording method according to the invention, even in a case where the recording medium is heated, an absolute value of the difference with the surface tension of the ink composition when the ink composition is evaporated up to an evaporation amount of 0% to 40% by mass being 1 mN/m or less makes it possible to obtain an excellent image by suppressing the generation of color differences.

In addition, in the recording methods of the related art, in more detail, the conditions under which bleeding occurs due to the fact that the difference in the surface tension of the ink composition before and after a predetermined amount of evaporation is large are presumed to be as follows. In the ink composition attached to the recording medium in a certain main scanning, the components of the ink composition on the recording medium evaporate during the period up to the main scanning after the next main scanning such that the surface tension of the ink composition changes greatly, then the ink composition ejected in the next main scanning and the ink composition attached in the certain main scanning come into contact and the components of the ink composition in the contact portion are shifted from each other and, due to this, the state of the attached ink composition is different in comparison with a case where there is no shifting, and, in a case where the recording region of the result is viewed as a whole, the quality of the recorded matter deteriorates due to the difference in colors, that is, the color difference. Furthermore, at different positions such as the edge and the middle in the main scanning direction of the recording medium, the time from the attachment of the ink composition in a certain main scanning to the attachment of the ink composition in the next main scanning is different and, due to this, it is presumed that color differences are easily generated between the positions where the ink composition is attached to the recording medium.

In addition, the recording method according to the invention preferably further includes the following configurations.

In the recording method, it is preferable to further include attaching a treatment liquid containing an aggregating agent which aggregates components of the ink composition to the recording medium.

In the recording method, the ink composition preferably further includes a surfactant, in which a content of the surfactant is 0.5% by mass or more with respect to a total amount of the ink composition.

In the recording method, the ink composition preferably further includes a pigment as a coloring material, and resin particles.

In the recording method, a surface tension of the ink composition before evaporation is preferably 28 mN/m or less.

In the recording method, the recording medium is preferably a low-absorptive recording medium or a non-absorptive recording medium.

In the recording method, an attachment amount of the ink composition per main scanning is preferably 4.0 mg/inch$^2$ or less.

In the recording method, in the attaching of the ink composition, at least a part of the ink composition ejected onto the recording medium in a next main scanning preferably contacts the ink composition attached to the recording medium in a certain main scanning.

In the recording method, in the attaching of the ink composition, an evaporation amount of the ink composition attached to the recording medium in a certain main scanning when the ink composition attached in the next main scanning comes into contact with the ink composition is preferably 60% by mass or less.

In the recording method, the attaching of the ink composition is preferably performed by a main scanning in which time for one main scanning is 1 second or more.

In the recording method, a recording region to which the ink composition and the treatment liquid are attached more preferably includes a region in which a ratio of an attachment amount of the treatment liquid with respect to an attachment amount of the ink composition is 40% by mass or less.

In the recording method, the ink composition preferably further includes one type or more of a silicone-based surfactant and a fluorine-based surfactant, and one type or more of a polyoxyalkylene alkyl ether-based surfactant and an acetylene glycol-based surfactant.

In the recording method, recording is preferably performed on a recording medium having a width in the main scanning direction of 50 cm or more.

According to another aspect of the invention, there is provided a recording apparatus for performing recording using the recording method according to the invention.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
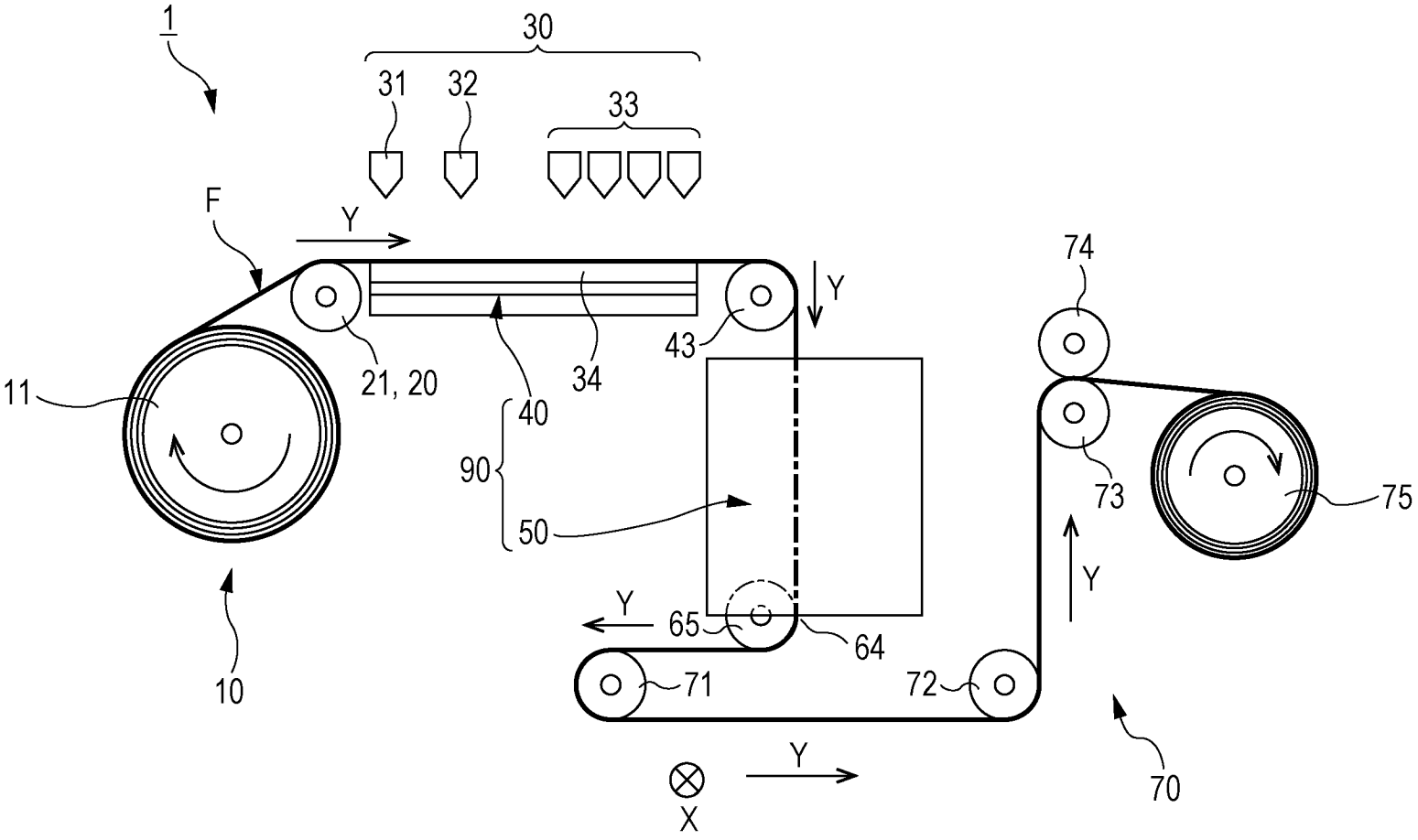
FIG. 1 is a side surface view showing an overall outline of an example of an ink jet recording apparatus able to be used in the present embodiment.

A detailed description will be given below of embodiments of the invention (referred to below as "the present embodiment") with reference to the drawings; however, the invention is not limited thereto and various modifications thereto are possible without departing from the gist thereof. In the drawings, the same reference numerals are given to the same elements and an overlapping explanation thereof is omitted. In addition, the positional relationships such as up, down, left, and right are based on the positional relationships shown in the drawings unless otherwise noted. Furthermore, the dimensional ratios of the drawings are not limited to the illustrated ratios.

Recording Method

The recording method of the present embodiment includes a heating step of heating a recording medium and an ink composition attaching step of attaching (applying) an ink composition (referred to below as the "ink composition of the present embodiment") including an organic solvent and water to the recording medium heated in the heating step by performing a main scanning, in which the ink composition is ejected from a recording head while a position of the recording head relative to the recording medium is changed in a main scanning direction, a plurality of times. In addition, an absolute value of a difference between a surface tension of the ink composition of the present embodiment and a surface tension of the ink composition when the ink composition is evaporated up to an evaporation amount of 0% to 40% by mass is 1 mN/m or less.

The recording method of the present embodiment may further include a treatment liquid attaching step of attaching a treatment liquid containing an aggregating agent which aggregates components of the ink composition to the recording medium. By further having a treatment liquid attaching step, the ink composition attached to the recording medium is fixed at an early stage, making it possible to suppress the temperature in the heating step to be low, that is, to reduce the evaporation amount of the ink composition attached on the recording medium, and there is a tendency for it to be possible to obtain a superior image quality. The treatment liquid is also referred to as a treatment liquid with the meaning of a liquid having a function of aggregating the components of the ink composition.

In the treatment liquid attaching step and the ink composition attaching step, the ink composition attaching step may be provided after the treatment liquid attaching step, the treatment liquid attaching step may be provided after the ink composition attaching step, or the treatment liquid attaching step and the ink composition attaching step may be provided at the same time. In addition, the heating step may be provided at the same time as the treatment liquid attaching step and the ink composition attaching step or before or after.

Using the recording method of the present embodiment makes it possible to obtain recorded matter that is excellent in image quality. Further, according to the recording method of the present embodiment, it is possible to obtain recorded matter that is excellent in ejection stability and abrasion resistance in addition to color difference. The reasons why using such a recording method makes it possible to obtain recorded matter excellent in image quality are considered to be as follows. However, the reasons are not limited thereto. That is, it is not possible for the recording methods of the related art to obtain excellent image quality due to the generation of bleeding due to the fact that ink compositions are used in which the surface tension of the ink composition changes greatly when a predetermined amount of the ink composition being used is evaporated in comparison with the surface tension of the ink composition before the evaporation.

In particular, in a case where the time required for one main scanning is long, due to the fact that a greater amount of the components in the attached ink composition are evaporated in the time up to the next main scanning, there is a tendency for it not to be possible to obtain excellent image quality due to the generation of color differences. In particular, there is a tendency for it not to be possible to obtain superior image quality in so-called large format printers with a large recording medium for the same reason.

On the other hand, in the recording method of the present embodiment, even in a case where the recording medium is heated, an absolute value of a difference between a surface tension of the ink composition and a surface tension of the ink composition when the ink composition is evaporated up to an evaporation amount of 0% to 40% by mass is 1 mN/m or less and, due to this, it is possible to obtain excellent image quality by suppressing the generation of bleeding. In addition, suppressing the generation of bleeding makes it possible to obtain recorded matter which is also excellent in color difference and abrasion resistance. Furthermore, the ink composition of the present embodiment is also excellent in ejection stability due to the fact that solid components are not easily fixed to the recording head.

Ink Composition

The ink composition used in the recording method of the present embodiment includes an organic solvent and water. A description will be given below of each component able to be contained in the ink composition.

The absolute value of a difference between a surface tension of the ink composition of the present embodiment and a surface tension of the ink composition when the ink composition is evaporated up to an evaporation amount of 0% to 40% by mass is 1 mN/m or less. Here, the absolute value of the difference in the surface tension described above is 1 mN/m or less at any evaporation amount when the ink composition is evaporated up to an evaporation amount of 0% to 40% by mass. The absolute value of the difference in the surface tension described above indicates the difference in the surface tension as a positive value. Therefore, the absolute value is a value of 0 or more.

The absolute value described above is preferably 0.9 mN/m or less, more preferably 0.8 mN/m or less, even more preferably 0.7 mN/m or less, yet more preferably 0.6 mN/m or less, and still more preferably 0.5 mN/m or less. The absolute value being in the ranges described above makes it possible to obtain recorded matter with excellent image quality. Specifically, it is possible to calculate the surface tension here by the measurement method of the Examples described below. In addition, the "evaporation amount" when the ink composition is evaporated up to an evaporation amount of XX % by mass is the mass ratio reduced by evaporation with respect to the total amount (100% by mass) of the ink composition including the solid content and solvent in the ink composition before evaporation. The components to be evaporated are mainly components having a low boiling point such as water and an organic solvent but are not particularly limited.

The absolute value of the difference between the surface tension of the ink composition of the present embodiment and the surface tension of the ink composition when the ink composition is evaporated up to an evaporation amount of 0% to 40% by mass is 0 mN/m or more and, while not limited, preferably 0.2 mN/m or more, more preferably 0.4 mN/m or more, and even more preferably 0.5 mN/m or less. The absolute value described above being in the ranges described above is preferable in terms of increasing the design flexibility of the recording method and being able to obtain recorded matter with excellent abrasion resistance.

In addition, the absolute value of the difference between the surface tension of the ink composition of the present embodiment and the surface tension of the ink composition when the ink composition is evaporated up to an evaporation amount of 20% by mass is 1 mN/m or less, preferably 0.7 mN/m or less, more preferably 0.5 mN/m or less, and even more preferably 0.3 mN/m or less. Being in the ranges described above is preferable in terms of being superior in image quality.

The surface tension of the ink composition is not particularly limited and is preferably 28 mN/m or less. The lower limit is 15 mN/m or more. Furthermore, the surface tension is preferably 15 to 28 mN/m, more preferably 16 to 27 mN/m, and even more preferably 18 to 26 mN/m. Due to the surface tension of the ink composition being in the ranges described above, there is a tendency for it to be possible to obtain recorded matter having superior image quality.

The surface tension of the ink composition is measured by the Wilhelmy method using a platinum plate in an environment of 25° C. using a surface tension meter. Measurement is performed at the initial value (before evaporation) and after evaporation. For the evaporation, the ink composition is exposed to the air and left to stand at 40° C., and, from the mass measurement, the surface tension of the ink composition is measured when at a predetermined evaporation amount.

Then, a difference between the surface tension of the initial ink composition and the surface tension of the ink composition at a predetermined evaporation amount is calculated, and the absolute value is calculated therefrom.

More specifically, the surface tension is determined by the measurement method described below, even more specifically, it is determined by the measurement method of the Examples described below.

In general, the surface tension values of ink compositions do not change greatly due to slight differences in the evaporation amount of the ink compositions. Therefore, in the present embodiment, the surface tension of the ink composition is measured for each of predetermined evaporation amount up to an evaporation amount of 0% to 40% by mass. Due to this, it is possible to confirm whether or not the absolute value of the difference between the surface tension of the ink composition before evaporation and the surface tension of the ink composition when the ink composition is evaporated to an evaporation amount of 0% to 40% by mass is 1 mN/m or less.

Examples of "measuring the surface tension of the ink composition at each of predetermined evaporation amount" include measuring the surface tension of the ink composition at intervals of 5% by mass in the order of 0% by mass, 5% by mass, 10% by mass, 15% by mass, 20% by mass, 25% by mass, 30% by mass, 35% by mass, and 40% by mass at evaporation amounts of 0% to 40% by mass. In the measurement results of the surface tension of the ink composition obtained in this manner, in a case where the difference from the surface tension of the ink composition before evaporation is a particularly large absolute value, the evaporation amount is determined corresponding to the measurement results and additional measurement may be performed. For example, for evaporation amounts in the range of 4% by mass above and below of the determined evaporation amount, the surface tension of the ink compositions may be further measured at different evaporation amounts at intervals of less than 5% by mass. Specifically, for a range of 4% by mass above and below of the determined evaporation amount of 30% by mass, the surface tension of the ink composition may be further measured at intervals of 1% by mass in the order of 26% by mass, 27% by mass, 28% by mass, 29% by mass, 30% by mass, 31% by mass, 32% by mass, 33% by mass, and 34% by mass at evaporation amounts of 26% to 34% by mass.

As described above, it is possible to confirm whether or not the absolute value of the difference between the surface tension of the ink composition before evaporation and the surface tension of the ink composition when the ink composition is evaporated to an evaporation amount of 0% to 40% by mass is 1 mN/M or less.

Coloring Material

The ink composition of the present embodiment may be a colored ink composition further including a coloring material or may be a clear ink composition. The colored ink composition is an ink used for coloring a recording medium. The clear ink composition is not an ink used for coloring the recording medium, but an ink used for improving the qualities such as the abrasion resistance and glossiness of the recorded matter, and the content of the coloring material in the clear ink composition is preferably 0.2% by mass or less, more preferably 0.1% by mass or less, even more preferably 0.05% by mass or less, particularly preferably 0.01% by mass or less, and may be 0% by mass.

As the coloring material, it is possible to use a pigment. The pigment is not particularly limited and examples thereof include the following.

Carbon black used for black inks is not particularly limited and examples thereof include No. 2300, No. 900, MCF 88, No. 33, No. 40, No. 45, No. 52, MA 7, MA 8, MA 100, No. 2200B, and the like (the above are manufactured by Mitsubishi Chemical Corporation), Raven 5750, Raven 5250, Raven 5000, Raven 3500, Raven 1255, Raven 700, and the like (the above are manufactured by Columbia Carbon Co., Ltd.), Regal 400 R, Regal 330 R, Regal 660 R, Mogul L, Monarch 700, Monarch 800, Monarch 880, Monarch 900, Monarch 1000, Monarch 1100, Monarch 1300, Monarch 1400, and the like (the above are manufactured by Cabot Corp.), and Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, and Special Black 4 (the above are manufactured by Degussa Co., Ltd.).

Pigments used for white inks are not particularly limited and examples thereof include C.I. Pigment White 6, 18, and 21, titanium oxide, zinc oxide, zinc sulfide, antimony oxide, zirconium oxide, white hollow resin particles, and polymer particles.

Pigments used for yellow inks is not particularly limited and examples thereof include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Pigments used for magenta inks are not particularly limited and examples thereof include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48:2, 48:5, 57:1, 88, 112, 114, 122, 123, 144, 146, 149, 150, 166, 168, 170, 171, 175, 176, 177, 178, 179, 184, 185, 187, 202, 209, 219, 224, and 245, or C.I. Pigment Violet 19, 23, 32, 33, 36, 38, 43, and 50.

Pigments used for cyan ink is not particularly limited and examples thereof include C.I. Pigment Blue 1, 2, 3, 15, 15:1, 15:2, 15:3, 15:34, 15:4, 16, 18, 22, 25, 60, 65, and 66, and C.I. Vat Blue 4 and 60.

In addition, pigments other than the pigments described above are not particularly limited and examples thereof include C.I. Pigment Green 7 and 10, C.I. Pigment Brown 3, 5, 25, and 26, and C.I. Pigment Orange 1, 2, 5, 7, 13, 14, 15, 16, 24, 34, 36, 38, 40, 43, and 63.

The coloring material preferably includes one type or two or more types of pigments selected from the group consisting of self-dispersion type pigments and polymer dispersion type pigments. Due to this, there is a tendency for the glossiness to be superior due to the fact that the coloring material is uniformly dispersed in the recorded matter.

A self-dispersion type pigment is a pigment having a hydrophilic group on the surface thereof. The hydrophilic group is preferably at least one type of hydrophilic group selected from the group consisting of —OM, —COOM, —CO—, —$SO_3M$, —$SO_2M$, —$SO_2NH_2$, —$RSO_2M$, —$PO_3HM$, —$PO_3M_2$, —$SO_2NHCOR$, —$NH_3$, and —$NR_3$.

In these chemical formulas, M represents a hydrogen atom, an alkali metal, ammonium, a phenyl group which may have a substituent, or organic ammonium, R represents an alkyl group having 1 to 12 carbon atoms or a naphthyl group which may have a substituent. In addition, M and R described above are selected independently of each other.

Specifically, the self-dispersion type pigment is produced by bonding (grafting) the hydrophilic group described above to the surface of the pigment by subjecting the pigment to a physical treatment and/or a chemical treatment. Specific examples of the physical treatment include vacuum plasma treatment and the like. In addition, specific examples of the chemical treatment include a wet oxidation method in which oxidation is carried out with an oxidizing agent in water, a method in which a carboxyl group is bonded via a phenyl group by bonding p-aminobenzoic acid to the pigment surface, and the like.

The polymer dispersion type pigment described above is a pigment made dispersible in a liquid by a polymer. It is possible to express the content of the polymer with respect to the pigment as the coverage of the polymer coating the pigment. The coverage of the polymer is preferably 1.0% to 50%, more preferably 1.0% to 10%, and even more preferably 1.0% to 5.0%. Due to the coverage being 1.0% or more, there is a tendency for the dispersibility to be favorable. In addition, due to the coverage being 50% or less, there is a tendency for the coloring property to be more favorable, and when 5.0% or less, there is a tendency for the coloring property to be even more favorable. A polymer for dispersing the pigment as described above is also referred to as a dispersant resin.

The polymer described above is preferably an acrylic resin in which, among the constituent components thereof, 70% by mass or more is a polymer obtained by copolymerization using at least an acrylic monomer such as (meth) acrylate, (meth)acrylic acid, or (meth)acrylamide as a constituent component. The constituent ratio of the acrylic monomer in the acrylic resin is preferably 30% by mass or more, more preferably 50% by mass or more, and even more preferably 70% by mass or more. The acrylic resin may be formed of a monomer of an acrylic monomer, and the constituent ratio of monomers other than the acrylic monomer is preferably 70% by mass or less, more preferably 50% by mass or less, and even more preferably 30% by mass or less.

Examples of monomers other than acrylic monomers include vinyl monomers, such as styrene.

Due to this, there is a tendency for the fixing property and glossiness of the ink to be superior. In addition, it is more preferable that at least one of alkyl(meth)acrylate having 1 to 24 carbon atoms and cyclic alkyl(meth)acrylate having 3 to 24 carbon atoms is polymerized from monomer components which are 70% by mass or more. Specific examples of the monomer component include methyl(meth)acrylate, ethyl(meth)acrylate, propyl(meth)acrylate, n-butyl(meth)acrylate, isobutyl(meth)acrylate, pentyl(meth)acrylate, hexyl (meth)acrylate, 2-ethylhexyl(meth)acrylate, octyl(meth) acrylate, nonyl(meth)acrylate, decyl(meth)acrylate, t-butyl cyclohexyl(meth)acrylate, lauryl(meth)acrylate, isobornyl (meth)acrylate, cetyl(meth)acrylate, stearyl(meth)acrylate, isostearyl(meth)acrylate, tetramethyl piperidyl(meth)acrylate, dicyclopentanyl(meth)acrylate, dicyclopentenyl(meth) acrylate, dicyclopentenyloxy (meth)acrylate, and behenyl (meth)acrylate. In addition, examples of other monomer components for polymerization also include hydroxy (meth) acrylate having a hydroxyl group such as hydroxyethyl (meth)acrylate, hydroxypropyl(meth)acrylate, and diethylene glycol (meth)acrylate, urethane (meth)acrylate, epoxy (meth)acrylate, and the like. Here, in the present specification, "(meth)acrylate" is a concept including both "methacrylate" and "acrylate".

In the ink composition, the content of the coloring material is preferably 0.1% to 25% by mass in terms of solid content with respect to the total amount (100% by mass) of the ink composition, more preferably 0.1% to 20% by mass, and even more preferably 0.1% to 18% by mass. Furthermore, the content of the coloring material is preferably 10% by mass or less, more preferably 6% by mass or less, and particularly preferably 5% by mass or less. Due to the content of the coloring material being in the ranges described above, there is a tendency for the coloring property to be further improved.

Resin Particles

The resin particles of the present embodiment (also referred to below as "resin dispersion", "resin emulsion", and "binder resin") are particles including a resin. The resin particles of the present embodiment may be resin particles of a self-dispersion type (self-dispersion type resin particles) into which a hydrophilic component necessary for stable dispersion in water is introduced or may be resin particles having water-dispersibility through the use of an external emulsifier. The ink composition of the present embodiment preferably further includes a pigment as a coloring material, and resin particles.

Examples of resins include acrylic resins (also referred to as (meth)acrylic resins), urethane-based resins, epoxy-based resins, and polyolefin-based resins (such as polyethylene resins), and examples of acrylic resins include styrene acrylic resins, fluorene-based resins, rosin-modified resins, terpene-based resins, polyester-based resins, polyamide-based resins, vinyl chloride-based resins, vinyl chloride-vinyl acetate copolymers, and ethylene vinyl acetate-based resins. Among the above, one type or two or more types selected from the group consisting of a (meth)acrylic resin, a urethane-based resin, an epoxy-based resin, a polyolefin-based resin, and a styrene acrylic resin is preferable, and one type or two or more types selected from the group consisting of a urethane-based resin and a styrene acrylic resin is even more preferable. One type of these resins may be used alone, or two or more types may be used in combination.

In the present specification, "(meth)acrylic" is a concept including both "methacrylic" and "acrylic". A case of referring to acrylic has a meaning including both "methacryl" and "acryl". Therefore, an acrylic resin is a resin formed of either an acrylic monomer or a methacrylic monomer.

Examples of urethane-based resins include polyether type urethane resins including, in addition to a urethane bond, an ether bond in the main chain, polyester type urethane resins including an ester bond in the main chain, and polycarbonate type urethane resins including a carbonate bond in the main chain. Among these, a polyester type urethane resin including an ester bond in the main chain is preferable. It is possible to use these urethane resins singly as one type or in a combination of a plurality of types.

Examples of commercially available products of urethane-based resins include UW-1501F, UW-5002 (the above are trade names manufactured by Ube Industries, Ltd.), W-6061, W-6110 (the above are trade names manufactured by Mitsui Chemicals, Inc.), UX-150, UX-390, and UX-200 (the above are trade names manufactured by Sanyo Chemical Industries, Ltd.).

Examples of styrene acrylic resins include aromatic vinyl monomers such as styrene, a-methyl styrene, vinyl toluene, 4-t-butyl styrene, chlorostyrene, vinyl anisole, and vinyl naphthalene, and copolymers with monomers used in the (meth)acrylic resins described above, and it is also possible to appropriately use known styrene acrylic resins. In addition, among the above, the styrene acrylic resins described in the Examples described below are preferable.

In the ink composition, the content of the resin particles is preferably 0.1% to 20% by mass in terms of solid content with respect to the total amount (100% by mass) of the ink composition, more preferably 1.0% to 15% by mass, and more preferably 1% to 12% by mass. Due to the content of the resin particles being in the ranges described above, there is a tendency for the abrasion resistance and the ejection stability to be superior.

Organic Solvent

The ink composition of the present embodiment includes an organic solvent. Due to this, there is a tendency for it to be possible to obtain excellent abrasion resistance and image quality due to the fact that it is possible to obtain the drying property of the ink composition landed on the recording medium at a higher level.

As the organic solvent, it is preferable to include a solvent (resin-soluble solvent) capable of swelling and/or dissolving a resin component such as the resin particles used in the present embodiment close to the heating temperature in the heating step described below. In a case where the ink composition includes a resin-soluble solvent, the ink components and the surface of the recording medium are dissolved to promote penetration of the ink into the recording medium so as to fix the ink on the recording medium, which is preferable in terms of the image quality, color difference reduction, abrasion resistance and the like being particularly excellent. Examples of resin-soluble solvents include amide-based solvents such as cyclic amides and non-cyclic amides among the organic solvents given as examples below.

The type of the organic solvent is not particularly limited and examples of the above and other organic solvents include cyclic nitrogen compounds, aprotic polar solvents, monoalcohols, alkyl polyols, glycol ethers, and the like.

The organic solvent preferably contains at least one of a cyclic nitrogen compound and an aprotic polar solvent. The ink composition containing a cyclic nitrogen compound or an aprotic polar solvent makes it possible to shift the apparent glass transition temperature of the resin particles to the lower temperature side, and to soften the core polymer and the shell polymer at a lower temperature than originally, thus, there is a tendency for it to be possible to improve the fixing property of the ink composition to the recording medium. Due to this, in particular, in a case where the recording medium is formed of polyvinyl chloride, it is possible to improve the fixing property of the ink composition to the recording medium.

The aprotic polar solvent is not particularly limited and examples thereof include cyclic ketone compounds, chain ketone compounds, and chain nitrogen compounds. In addition, representative examples of the cyclic nitrogen compound and the aprotic polar solvent include pyrrolidone-based, imidazolidinone-based, sulfoxide-based, lactone-based, and amide ether-based solvents. Specifically, among the above, 2-pyrrolidone, N-alkyl-2-pyrrolidone (for example, N-methylpyrrolidone), 1-alkyl-2-pyrrolidone, γ-butyrolactone, 1,3-dimethyl-2-imidazolidinone, dimethylsulfoxide, imidazole, 1-methylimidazole, 2-methylimidazole, and 1,2-dimethylimidazole are preferable.

Examples of cyclic amides include amides having a cyclic structure such as pyrrolidones, among those described above.

Examples of non-cyclic amides include amides having a non-cyclic structure among those described above and although not particularly limited, examples thereof include N,N-dialkylpropionamides, for example, 3-butoxy-N,N-dimethyl propionamide, and 3-methoxy-N,N-dimethylpropionamide.

The monoalcohol is not particularly limited and examples thereof include methanol, ethanol, n-propyl alcohol, isopropyl alcohol, n-butanol, 2-butanol, tert-butanol, iso-butanol, n-pentanol, 2-pentanol, 3-pentanol, and tert-pentanol.

The alkyl polyols are not particularly limited and examples thereof include glycerin, ethylene glycol, diethylene glycol, triethylene glycol, propylene glycol (1,2-propane diol), dipropylene glycol, 1,3-propylene glycol (1,3-propane diol), isobutylene glycol (2-methyl-1,2-propanediol), 1,2-butanediol, 1,3-butanediol (1,3-butylene glycol), 1,4-butanediol, 2-butene-1,4-diol, 1,2-pentanediol, 1,5-pentanediol, 2-methyl-2,4-pentanediol, 1,2-hexanediol, 1,6-hexanediol, 2-ethyl-1,3-hexanediol, 1,7-heptanediol, and 1,8-octanediol. Alkyl polyols having 2 to 8 carbon atoms are preferable, and the number of hydroxyl groups is preferably 2 to 3. In a case where the ink composition includes an alkyl polyol, the ejection stability, abrasion resistance, and image quality are particularly excellent, which is preferable.

The glycol ether is not particularly limited and examples thereof include diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol monobutyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol monomethyl ether, dipropylene glycol mono-n-butyl ether, dipropylene glycol mono-n-propyl ether, and dipropylene glycol mono-iso-propyl ether. Glycol ethers having 3 to 10 carbon atoms are preferable. In addition, ethers with an alkyl group having 4 or less carbon atoms are preferable. In addition, a monoether is preferable. In a case where the ink composition includes glycol ether, the ejection stability and image quality are particularly excellent, which is preferable.

The content of the organic solvent is preferably 3.0% to 70% by mass with respect to the total amount (100% by mass) of the ink composition, more preferably 5.0% to 50% by mass, and even more preferably 10% to 30% by mass. Due to the content of the organic solvent being 70% by mass or less, there is a tendency for the drying property of the ink composition attached to the recording medium to be further improved. In addition, due to the content of the organic solvent being 3.0% by mass or more, there is a tendency for it to be possible to secure the ejection stability of the ink composition.

The organic solvent is preferably an organic solvent having a normal boiling point of 270° C. or lower, more preferably an organic solvent of 150 to 250° C., and particularly preferably an organic solvent of 180 to 230° C. In a case where the boiling point of the organic solvent is in the ranges described above, the ejection stability, abrasion resistance, image quality, and the like are superior. In addition, it is possible to set the content of the organic solvent having a normal boiling point in the range described above in the ink in the range of the preferable content of the organic solvent, which is preferable.

It is possible to appropriately select the organic solvent having a normal boiling point within the range described above from among the organic solvents given as examples above.

In addition, in the ink composition of the present embodiment, the content of the organic solvent which is an alkylpolyol having a normal boiling point of 280° C. or higher is preferably 5.0% by mass or less with respect to the total amount (100% by mass) of the ink composition, more preferably 3.0% by mass or less, even more preferably 1.0% by mass or less, particularly preferably 0.5% by mass or less, and yet more preferably 0.02% by mass or less, and the lower limit thereof is 0% by mass or more.

In addition, the content of the organic solvent having a normal boiling point of 280° C. or higher is preferably 5.0% by mass or less with respect to the total amount (100% by mass) of the ink composition, more preferably 3.0% by mass or less, and even more preferably 1.0% by mass or less, and the lower limit of the content is 0% by mass or more. It is possible to appropriately select the organic solvent having a normal boiling point of 280° C. or higher from the organic solvents given as examples below. In a case where the content of the organic solvent having a normal boiling point of 280° C. or higher, particularly, the organic solvent which is a polyol, is in the range described above, the image quality and abrasion resistance of the ink are particularly excellent, which is preferable.

In addition, the content of the resin-soluble solvent is preferably 5% to 35% by mass or less with respect to the total amount (100% by mass) of the ink composition, more preferably 10% to 30% by mass or less, and even more preferably 15% to 25% by mass or less.

In addition, the content of the organic solvent other than the resin-soluble solvent is preferably 3% to 30% by mass with respect to the total amount (100% by mass) of the ink composition, more preferably 5% to 25% by mass, and even more preferably 10% to 20% by mass. In a case where the content of each organic solvent is in the ranges described above, it is preferable in terms of having superior image quality, ejection stability, color difference reduction, and abrasion resistance. Examples of organic solvents other than the resin-soluble solvent include, in particular, alkyl polyol or glycol ether.

Surfactant

The ink composition preferably further includes a surfactant. By including the surfactant, an absolute value of a difference between a surface tension of the ink composition and a surface tension of the ink during surface evaporation of the ink composition when the ink composition is evaporated up to an evaporation amount of 0% to 40% by mass is easily controlled so as to be 1 mN/m or less and there is a tendency for it to be possible to obtain superior image quality. The surfactant is not particularly limited, and examples thereof include a polyoxyalkylene alkyl ether-based surfactant, an acetylene glycol-based surfactant, a fluorine-based surfactant, a silicone-based surfactant, and the like. Among these, fluorine-based surfactants and silicone-based surfactants are preferable. In addition, including one type or more of a fluorine-based surfactant and a silicone-based surfactant and one type or more of a polyoxyalkylene alkyl ether-based surfactant and an acetylene glycol-based surfactant is more preferable in terms of color difference reduction.

The polyoxyalkylene alkyl ether-based surfactant is not particularly limited and examples thereof include polyoxyethylene alkyl ethers and commercially available products thereof include DW 800 (trade name, manufactured by BYK-Chemie, polyoxyethylene alkyl ether group-containing surfactant). The polyoxyethylene alkyl ether-based surfactant may be used singly as one type or in a combination of two or more types thereof.

The acetylene glycol-based surfactant is not particularly limited and one type or more selected from 2,4,7,9-tetramethyl-5-decyne-4,7-diol and alkylene oxide adducts of 2,4,7,9-tetramethyl-5-decyne-4,7-diol, and 2,4-dimethyl-5-decyne-4-ol and alkylene oxide adducts of 2,4-dimethyl-5-decyne-4-ol is preferable. Commercially available products of the acetylene glycol-based surfactant are not particularly limited and examples thereof include E series (trade name, manufactured by Air Products Japan, Inc.) such as Olfine 104 series and Olfine E 1010, and Surfynol 104, 465, 61, and DF 110D (trade names, manufactured by Nissin Chemical Industry Co., Ltd.). The acetylene glycol-based surfactant may be used singly as one type or in a combination of two or more types.

The fluorine-based surfactant is not particularly limited and examples thereof include perfluoroalkyl sulfonate, perfluoroalkyl carboxylate, perfluoroalkyl phosphate ester, perfluoroalkyl ethylene oxide adducts, perfluoroalkyl betaine, and perfluoroalkyl amine oxide compounds. Commercially available products of the fluorine-based surfactant are not particularly limited and examples thereof include MF 410 (trade name, manufactured by DIC Corporation, perfluoroalkyl group-containing carboxylate surfactant), S-144, S-145 (the above are trade names, manufactured by AGC Inc.); FC-170C, FC-430, Fluorad-FC4430 (the above are trade names manufactured by Sumitomo 3M Ltd.); FSO, FSO-100, FSN, FSN-100, and FS-300, (the above are trade names manufactured by Dupont), and FT-250 and 251 (the above are trade names manufactured by Neos Co., Ltd.). The fluorine-based surfactant may be used singly as one type or in a combination of two or more types thereof.

The silicone-based surfactant is not particularly limited and examples thereof include a polysiloxane-based compound and a polyether-modified organosiloxane. Commercially available silicone-based surfactants are not particularly limited and specific examples thereof include BYK-306, BYK-307, BYK-333, BYK-341, BYK-345, BYK-346, BYK-347, BYK-348, and BYK-349 (the above are trade names manufactured by BYK Chemie), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (the above are trade names manufactured by Shin-Etsu Chemical Co., Ltd.), and the like. The silicone-based surfactant may be used singly as one type or in a combination of two or more types thereof.

The content of the surfactant is preferably 0.3% to 2.5% by mass with respect to the total amount (100% by mass) of the ink composition, more preferably 0.5% to 1.8% by mass and more preferably 0.5% to 1.5% by mass. Due to the content of the surfactant being in the range described above, the wettability of the ink composition attached to the recording medium is further improved, superior image quality is obtained, and there is a tendency for the ejection stability to be superior.

The content of any one type or more of the fluorine-based surfactant and the silicone-based surfactant is preferably 0.2% to 2.5% by mass with respect to the total mass of the ink composition, more preferably 0.5% to 1.8% by mass, and even more preferably 0.5% to 1.5% by mass.

In addition, the content of any one type or more of the polyoxyalkylene alkyl ether-based surfactant and the acetylene glycol-based surfactant is preferably 0.05% to 1% by mass with respect to the total mass of the ink composition, more preferably 0.1% to 0.8% by mass, and even more preferably 0.3% to 0.7% by mass.

Water

Examples of the water of the present embodiment include water from which ionic impurities are removed as much as possible such as pure water or ultrapure water such as ion exchanged water, ultra-filtered water, reverse osmosis water, and distilled water. In addition, when water sterilized by ultraviolet irradiation, the addition of hydrogen peroxide, or the like is used, it is possible to prevent the generation of mold and bacteria when the treatment liquid is stored for a long time. Due to this, there is a tendency for the storage stability to be further improved. The content of water in the ink composition is preferably 40% by mass or more, more preferably 50% by mass or more, and even more preferably 60% by mass or more. Although the upper limit of the content of water is not limited, the upper limit is preferably 95% by mass or less.

The ink composition of the present embodiment is preferably a water-based ink composition. Water-based means at least containing water as a main component as a solvent component included in the composition and that the content of the water in the composition is 30% by mass or more. A water-based composition is preferable from the viewpoint of low pollution, low toxicity, and high safety.

It is also possible for the ink composition to appropriately contain various types of additives as other components, such as a dissolution aid, a viscosity adjusting agent, a pH adjusting agent, an antioxidant, a preservative, a mildew proofing agent, a corrosion inhibitor, and a chelating agent (for example, sodium ethylenediaminetetraacetate) which captures metal ions which affect dispersion.

Treatment Liquid

In the recording method of the present embodiment, a treatment liquid may be used. The treatment liquid contains an aggregating agent capable of aggregating or thickening the ink composition described above. Using the ink composition of the present embodiment along with the treatment liquid in a recording method makes it possible to obtain recorded matter having excellent image quality. The treatment liquid aggregates the components included in the ink composition due to the aggregating agent in the treatment liquid interacting with the ink composition and thickens or insolubilizes the ink composition. Due to this, it is possible to suppress landing interference and bleeding of the ink composition to be attached thereafter, and to draw lines, fine images, and the like uniformly. In a case where the recording method uses a treatment liquid, it is possible to stop the flow of ink on the recording medium by aggregating the components of the ink, which is preferable in terms of the image quality being excellent even when the evaporation amount of the ink is low. In addition, since the image quality is excellent even if the evaporation amount of the ink is low, it is possible to lower the evaporation amount of the ink, and the color difference reduction is excellent, which is preferable.

Aggregating Agent

The aggregating agent contained in the treatment liquid is not particularly limited and it is preferable to include any one of a cationic resin, an organic acid, and a polyvalent metal salt. Due to this, there is a tendency for printing unevenness and bleeding to be further suppressed. Among the components included in the ink composition, examples of components which are aggregated by the aggregating agent include the pigment and the resin used for the resin particles described above.

The cationic resin is not particularly limited and examples thereof include a cationic polymer. From the viewpoint of more effectively and reliably achieving the effect of the invention, examples of cationic polymers include polyallylamine resins such as polyethyleneimine, polydiallylamine, and polyallylamine, alkylamine polymers, and polymers having primary to tertiary amino groups and quaternary ammonium salt groups described in JP-A-59-20696, JP-A-59-33176, JP-A-59-33177, JP-A-59-155088, JP-A-60-11389, JP-A-60-49990, JP-A-60-83882, JP-A-60-109894, JP-A-62-198493, JP-A-63-49478, JP-A-63-115780, JP-A-63-280681, JP-A-1-40371, JP-A-6-234268, JP-A-7-125411, JP-A-10-193776, and the like are preferably used. From the same viewpoint, the weight average molecular weight of these cationic polymers is preferably 5,000 or more, and more preferably approximately 5,000 to 100,000. The weight average molecular weight of the cationic polymer is measured by gel permeation chromatography using polystyrene as a standard substance.

Among cationic resins, cationic amine-based resins such as polyallylamine resin, polyamine resin, and polyamide resin are preferable in terms of excellent image quality. Polyallylamine resins, polyamine resins, and polyamide resins are resins each having a polyallylamine structure, a polyamine structure, and a polyamide structure in the main skeleton of the polymer.

The organic acid is not particularly limited and is preferably a carboxylic acid, and examples thereof include maleic acid, acetic acid, phosphoric acid, oxalic acid, malonic acid, succinic acid, and citric acid. Among these, a monovalent or divalent or higher carboxylic acid is preferable. Including such a carboxylic acid further improves the aggregating effect of the polymer and the wax and there is a tendency for the coloring property to be superior. Here, organic acids may be used singly as one type or in a combination of two or more types thereof.

The polyvalent metal salt is not particularly limited and a polyvalent metal salt of an inorganic acid or a polyvalent metal salt of an organic acid is preferable from the viewpoint of more effectively and reliably exhibiting the effects of the invention. Such polyvalent metal salts are not particularly limited and examples thereof include alkaline earth metals of Group 2 of the periodic table (for example, magnesium and calcium), transition metals of Group 3 of the periodic table (for example, lanthanum), Earth metals of Group 13 of the periodic table (for example, aluminum), and lanthanides (for example, neodymium). In addition, as salts of these polyvalent metals, carboxylic acid salts (for example, formic acid, acetic acid, and benzoic acid salts), sulfates, nitrates, chlorides, and thiocyanates are suitable. Among these, as the polyvalent metal salt, one type or two or more types selected from the group consisting of calcium salt or magnesium salt of carboxylic acid (formic acid, acetic acid, benzoic acid salts, and the like), calcium salt or magnesium salt of sulfuric acid, calcium salt or magnesium salt of nitric acid, calcium chloride, magnesium chloride, and calcium salt or magnesium salt of thiocyanic acid are preferable. The polyvalent metal salt may be used singly as one type or in a combination of two or more types thereof.

The content of the aggregating agent is preferably 0.1% to 25% by mass in terms of solid content with respect to the total amount (100% by mass) of the treatment liquid, more preferably 1% to 25% by mass, even more preferably 1% to 20% by mass, particularly preferably 1% to 10% by mass, and still more preferably 1% to 7% by mass. Due to the content of the aggregating agent being in the above range, there is a tendency for it to be possible to obtain recorded matter with superior image quality.

The treatment liquid used in the present embodiment may include a surfactant, an organic solvent, and water in the same manner as the treatment liquid used in the ink composition described above, independently of the ink composition. In addition, it is also possible to appropriately add various additives to the treatment liquid as other components, such as a dissolution aid, a viscosity adjusting agent, a pH adjusting agent, an antioxidant, a preservative, a mildew proofing agent, a corrosion inhibitor, and a chelating agent which captures metal ions which affect dispersion.

Heating Step

The recording method of the present embodiment has a step of heating the recording medium. Through the heating step, it is possible for the recording method to promote evaporation of the ink composition attached to the recording medium so as to suppress bleeding and obtain excellent image quality. The means for heating in the heating step is not particularly limited as long as it is possible to heat the recording medium and examples thereof include heating by a heater. The heating preferably uses at least one of a conduction method in which heat is conducted to the recording medium from a member such as a recording medium support unit in contact with the recording medium, a blowing method which blows heated wind to the recording medium using a fan or the like, a radiation method which the recording medium is irradiated with irradiation which generates heat such as IR, or the like. The ink composition attaching step is preferably performed on a recording medium which is heated by the heating step to have a temperature higher than room temperature from the viewpoint of excellent image quality and the like. The heating step is preferably performed before or at the same time as the ink composition attaching step.

From the viewpoint of improving the quality of the formed images, the lower limit in the heating step is not limited and the lower limit is preferably 25° C. or higher, more preferably 30° C. or higher, even more preferably 32° C. or higher, and yet more preferably 35° C. or higher. The temperature is preferably 45° C. or lower, more preferably 40° C. or lower, and even more preferably 38° C. or lower in terms of excellent ejection stability. The temperature is the surface temperature of the locations where the ink is attached on the recording surface of the recording medium.

It is possible to realize the heating step through, for example, a first drying unit 40 provided in a recording apparatus described below.

Post-Heating Step

The recording method of the present embodiment may have a post-heating step of heating the recording medium after the ink composition attaching step. As means for heating in the post-heating step, it is possible to separately and independently use the means preferably used in the heating step described above. The post-heating step may be a step of performing final heating such that it is possible to use the recorded matter. It is possible to realize the post-heating step by, for example, a second drying unit 50 provided in a recording apparatus described below. The surface temperature of the recording medium in the post-heating step is preferably 50° C. to 120° C., more preferably 60° C. to 100° C., and even more preferably 70° C. to 90° C.

Treatment Liquid Attaching Step

The recording method of the present embodiment may have a treatment liquid attaching step. The treatment liquid attaching step is a step of attaching (applying) the treatment liquid to the recording medium. The means for attaching the treatment liquid is not particularly limited and, for example, it is possible to use roller coating, spray coating, or an ink jet method. Among the above, it is preferable to carry out the attachment by the ink jet method. By attaching the treatment liquid by the ink jet method, there is a tendency to suppress changes in the surface quality of the medium and further improve the abrasion resistance.

The attachment amount of the treatment liquid in the recording region of the recorded matter is preferably 0.1 to 20 mg/inch$^2$, more preferably 1.0 to 15 mg/inch$^2$, and even more preferably 2.0 to 10 mg/inch$^2$. Due to the attachment amount of the treatment liquid being in the ranges described above, there is a tendency to obtain recorded matter having superior image quality. Here, the "recording region" is a region in which an image is formed on the surface of the recording medium.

In a case where the ink composition attaching step is provided after the treatment liquid attaching step, the time interval from the end of the treatment liquid attaching step to the start of the ink composition attaching step is preferably 30 seconds or less, more preferably 0.01 to 20 seconds, even more preferably 0.01 to 15 seconds, and particularly preferably 0.01 to 10 seconds. Due to the time interval from the end of the treatment liquid attaching step to the start of the ink composition attaching step being 10 seconds or less, the reaction efficiency of the treatment liquid and the ink composition is further improved, and there is a tendency for the image quality of the obtained recorded matter to be further improved. In particular, when the film thickness of the film formed by the ink composition is small, the time interval is preferably short.

Here, the attachment amount of the treatment liquid is comparatively small in comparison with the attachment amount of the ink composition and, additionally, since the evaporation of the treatment liquid proceeds in the time from the attachment of the treatment liquid to the attachment of the ink composition, it is presumed that the influence of the unevaporated components remaining in the recording medium due to the treatment liquid on the ink composition is small at the time of attaching the ink composition to the recording medium.

Ink Composition Attaching Step

The ink composition attaching step is a step of attaching (applying) the ink composition to the recording medium and is a step of obtaining recorded matter by performing the main scanning, in which the ink composition of the present embodiment is ejected from the recording head and attached to the recording medium while the position of the recording head relative to the recording medium is changed in the main scanning direction, a plurality of times. It is possible to provide the ink composition attaching step at the same time as the treatment liquid attaching step or before or after the treatment liquid attaching step; however, from the point of view of more effectively and reliably achieving the operation and effects according to the invention, the ink composition attaching step is preferably provided after the treatment liquid attaching step. Means for attaching the ink composition is not particularly limited and it is possible to use, for example, roller coating, spray coating, or an ink jet method. Among the above, it is preferable to carry out the attachment by the ink jet method. By attaching the ink composition by the ink jet method, there is a tendency to suppress changes in the surface quality of the medium and further improve the abrasion resistance.

Regarding the time for one main scanning in the ink composition attaching step, the main scanning is preferably performed in 1 second or more, the main scanning is more preferably performed in 2 seconds or more, and the main scanning is even more preferably performed in 3 seconds or more. In addition, it is preferable to perform the main scanning with the time being 6 seconds or less, the main scanning is more preferably performed in 4 seconds or less, and the main scanning is even more preferably performed in 3 seconds or less.

Depending on the image to be recorded, the main scanning may include a scanning which does not record from one end to the other end in the main scanning direction of the recording medium. In addition, the recording method may have a main scanning in a case where the recording is carried out from one end to the other end where recording of the main scanning direction of the recording medium is possible and the time of the main scanning in such a case is set as "the maximum time for one main scanning". The maximum time for one main scanning is also preferably in the range described above. A case where the time for one main scanning is in the range described above is preferable in terms of being able to record useful recorded matter with a large recording width and in terms of obtaining superior color difference reduction in the recorded matter and ejection stability.

Regarding the ink attachment amount, the recording region of the recorded matter preferably has a region in which the attachment amount is 7 to 50 mg/inch$^2$, more preferably has a region in which the attachment amount is 10 to 25 mg/inch$^2$, and even more preferably has a region in which the attachment amount is 12 to 25 mg/inch$^2$. Due to the ink attachment amount being in the ranges described above, there is a tendency for the image quality of the obtained recorded matter to be superior. In addition, the ink attachment amount in the region where the ink attachment amount is the maximum in the recording region is also preferably in the ranges described above.

In a recording region in a case where the recording method of the present embodiment has a treatment liquid attaching step, it is preferable to have a region in which the ratio of the attachment amount of the treatment liquid with respect to the attachment amount (100% by mass) of the ink composition is 40% by mass or less, it is more preferable to have a region in which the ratio is 3% to 30% by mass, it is even more preferable to have a region in which the ratio is 5% to 20% by mass, and it is particularly preferable to have a region in which the ratio is 7% to 15% by mass. Due to the ratio described above being in the range described above, there is a tendency for the image quality of the obtained recorded matter to be superior. In the recording method, it is also preferable that the ratio of the attachment amount of the treatment liquid with respect to the attachment amount of the ink composition is in the range described above in the region where the attachment amount of the ink composition is the largest in the recording region. In addition, in the recording method, it is also preferable that the upper limit of the ratio of the attachment amount of the treatment liquid with respect to the attachment amount of the ink composition in the recording region is in the range described above.

In the ink composition attaching step, the ink attachment amount in one main scanning is preferably 4.0 mg/inch$^2$ or less, more preferably 3.0 mg/inch$^2$ or less, even more preferably 2.0 mg/inch$^2$ or less, and preferably 0.3 mg/inch$^2$ or more, more preferably 0.7 mg/inch$^2$ or more, and even more preferably 1.0 mg/inch$^2$ or more. Due to the ink attachment amount in one main scanning being in the range described above, there is a tendency for the image quality of the obtained recorded matter to be superior.

The ink composition attaching step also preferably has a main scanning in which the ink attachment amount in one main scanning is in the range described above. In addition, in the ink composition attaching step, the main scanning in which the ink attachment amount in one main scanning is the maximum is also preferably in the range described above.

Here, by having a main scanning in which the ink attachment amount in one main scanning is in the range described above and attaching the ink to the recording region by performing the main scanning a plurality of times, the ink attachment amount may be set in the recording region of the recorded matter.

In the ink composition attaching step, at least a part of (some of) the ink composition ejected to the recording medium in the next main scanning comes into contact with the ink composition attached to the recording medium in a certain main scanning. Here, the "next main scanning" (e.g., second, next, or subsequent) is the scanning performed after a certain main scanning (e.g., first, prior, or earlier).

In addition, the evaporation amount of the ink composition attached in a certain main scanning which evaporates before the next main scanning after the certain main scanning is performed is preferably 60% by mass or less, more preferably 50% by mass or less, even more preferably 45% by mass or less, and yet more preferably 40% by mass or less. In addition, the evaporation amount is also preferably 10% by mass or more, more preferably 20% by mass or more, and even more preferably 30% by mass or more. The evaporation amount described above is the evaporation amount after a time twice as long as the time of one scanning from attachment of the ink composition attached to the recording medium. The evaporation amount is the "ink evaporation amount between scannings" measured in the Examples described below. The time is assumed to be the time from after ink is attached to one end in a certain main scanning performed from one end to the other end of the recording medium, until the main scanning is performed from the other end of the recording medium to the one end in the next main scanning and the ink is attached to the one end. The time is assumed to be the longest time in a case assuming that the ink attached in a certain main scanning comes into contact with the ink attached in the next main scanning.

It is possible to confirm the evaporation amount by measuring the decrease in mass after a time twice as long as the time for one main scanning from the attachment of the ink composition attached to the recording medium in the main scanning under the conditions of the recording method. The mass is the mass of the entire ink composition. When measuring the evaporation amount, a method may be used in which a measurement operation is performed, the ink composition is attached to the recording medium under the same conditions as the recording method without using the treatment liquid, a calibration curve of the mass change is obtained from the elapsed time after the attachment and the measurement of the mass, and the mass change after twice the time of one scanning is obtained. When the evaporation amount is in the range described above, there is a tendency for the image quality and color difference reduction of obtained recorded matter to be superior.

Recording Medium

Examples of the recording medium include an absorptive, low-absorptive, or non-absorptive recording media. Among these, the recording medium is preferably a low-absorptive recording medium or a non-absorptive recording medium. In a case where a low-absorptive recording medium or a non-absorptive recording medium is used, since the treatment liquid is repelled on the surface thereof and the aggregating agent is hard to apply uniformly, printing unevenness and bleeding occur more easily. However, the present embodiment is particularly useful since it is possible to prevent the treatment liquid from being repelled by the ink composition. In addition, in a case where a low-absorptive recording medium or a non-absorptive recording medium is used, since the aggregating agent tends to remain on the surface of the recording medium without penetrating into the recording medium, there is a tendency for the stickiness and abrasion resistance of the recording surface to deteriorate. However, in the present embodiment, since it is possible for the use amount of the treatment liquid to be reduced by using the ink composition described above, it is possible to improve the stickiness of the recording surface, which is particularly advantageous.

Here, the "low-absorptive recording medium" or "non-absorptive recording medium" means a recording medium having a water absorption amount of 10 mL/m$^2$ or less from the start of contact until after 30 msec in the Bristow method. The Bristow method is the most popular method for measuring the amount of liquid absorption in a short time and is also adopted by Japan Technical Association of the Pulp and Paper Industry (JAPAN TAPPI). For details of the test method, please refer to the standard No. 51 "Paper and paperboard—Liquid absorbency test method—Bristow method" of "JAPAN TAPPI 2000 Paper Pulp Test Method".

In addition, it is possible to classify the non-absorptive recording medium or the low-absorptive recording medium according to the wettability with respect to water on the recording surface. Specifically, it is possible to determine the characteristics of the recording medium by dropping 0.5 μL of water droplets onto the recording surface of the recording medium and measuring the decrease ratio of the contact angle (the comparison between the contact angle at 0.5 msec after landing and the contact angle at 5 seconds). More specifically, as a property of the recording medium, the non-absorbability of the "non-absorptive recording medium" means that the decrease ratio described above is less than 1%, and the low absorbability of the "low-absorptive recording medium" means that the decrease ratio described above is 1% or more and less than 5%. In addition, absorbability means that the decrease ratio described above is 5% or more. It is possible to measure the contact angle using a portable contact angle meter PCA-1 (manufactured by Kyowa Interface Science Co., Ltd.) or the like.

The absorptive recording media are not particularly limited and examples thereof include plain paper such as electrophotographic paper having high ink composition permeability, ink jet paper (ink jet specialty paper provided with an ink absorbing layer formed of silica particles or alumina particles, or an ink absorbing layer formed of a hydrophilic polymer such as polyvinyl alcohol (PVA) or polyvinyl pyrrolidone (PVP)), and art paper, coated paper, and cast paper used for general offset printing having relatively low ink composition permeability.

The low-absorptive recording medium is not particularly limited and examples thereof include coated paper provided with a coating layer for receiving an oil-based ink on the surface thereof. The coated paper is not particularly limited and examples thereof include printed paper such as art paper, coated paper, and matte paper.

The non-absorptive recording medium is not particularly limited and examples thereof include a recording medium in which plastic is coated on a base material such as a plastic film or paper having no ink absorbing layer, a recording medium to which a plastic film is adhered, and the like. Examples of plastics here include polyvinyl chloride, polyethylene terephthalate, polycarbonate, polystyrene, polyurethane, polyethylene, and polypropylene.

Furthermore, in addition to the recording medium described above, it is also possible to use an ink non-absorptive or low-absorptive recording medium such as a plate of a metal such as iron, silver, copper, or aluminum, or glass.

In particular, the recording medium is preferably in the shape of a roll. When recording, it is possible to use the roll-shaped recording medium in a manner in which the recording head scans relative to the recording medium once, which is then wound up by a wind-up roller. In a case where such a recording medium is used and where recording is performed a number of times without being able to record all the colors in one feeding for the reason that the number of colored ink types to be used is large or the like, it is possible to obtain the recorded matter by repeating the operation, in which the recording head scans relative to the recording medium once and the wind-up roller performs winding up, a plurality of times. However, since the recording medium is in the shape of a roll, there is a tendency for cracks to occur easily in the layer formed of the polymer in the recorded matter. In a case where a crack occurs, there is a tendency for the image quality of the obtained recorded matter to be lowered due to the penetration of the treatment liquid into the crack and the like. However, cracks do not easily occur in the coating film formed by the ink composition obtained by the recording method of the present embodiment. Therefore, the invention is particularly useful in a case of using a recording medium having such a shape.

The width (length) of the recording medium in the main scanning direction is preferably 50 cm or more, more preferably 100 cm or more, and even more preferably 150 cm or more. In addition, the width is preferably 300 cm or less, more preferably 250 cm or less, and even more preferably 200 cm or less. A case where the width is in the range described above is preferable in terms of being able to record highly useful recorded matter and in terms of excellent image quality, color difference reduction, and ejection stability.

Recording Apparatus

Next, a description will be given of a recording apparatus of the present embodiment for performing recording using the recording method of the present embodiment. The recording apparatus of the present embodiment is not particularly limited as long as it is a recording apparatus capable of carrying out recording using the recording method of the present embodiment. FIG. 1 is a side surface view schematically showing the overall outline of an example of the ink jet recording apparatus 1 able to be used in the present embodiment. As shown in FIG. 1, the ink jet recording apparatus 1 is provided with a feeding unit 10 for a recording medium, a transport unit 20, a recording unit 30, a drying unit 90, and a discharging unit 70.

In the above, the drying unit 90 has the first drying unit 40 for drying the treatment liquid and primarily drying the ink composition, and the second drying unit 50 for drying the recorded matter obtained by the recording method according to the present embodiment.

In addition, the feeding unit 10 is provided so as to be able to feed the roll-shaped recording medium F to the transport unit 20. Specifically, the feeding unit 10 has a roll medium holder 11, and the roll medium holder 11 holds a roll-shaped recording medium F. The feeding unit 10 is configured such that it is possible to feed the recording medium F to the transport unit 20 on the downstream side in the feeding direction Y by rotating the roll-shaped recording medium F.

Furthermore, the transport unit 20 is provided so that it is possible to transport the recording medium F sent from the feeding unit 10 to the recording unit 30. Specifically, the transport unit 20 has a first feed roller 21, and is configured to be able to transport the sent recording medium F to the recording unit 30 further on the downstream side in the feeding direction Y.

In addition, the recording unit 30 is provided so as to be able to coat a treatment liquid on the recording medium F sent from the transport unit 20 and to eject the ink composition to carry out recording. Specifically, the recording unit 30 is provided with heads 31 and 32 for performing a treatment liquid attaching step, a recording head 33 for performing an ink composition attaching step, and a platen 34 as a medium support unit. However, in the present embodiment, the head 31 is not used. The head 32 and the head 33 are mounted on the same carriage (not shown). The carriage performs a scanning (main scanning) in which the ink composition and the treatment liquid are ejected from the head and attached to the recording medium opposed to the head while being moved in front and back direction of the figure. The recording is performed by alternately performing the scanning and transporting (sub-scanning) of the recording medium. That is, a multi-pass recording method is performed in which recording is performed by performing the scanning a plurality of times.

In the above, the platen 34 is provided so as to be able to support the recording medium F from the back side. In addition, the platen 34 is provided with the first drying unit 40 (corresponding to heating means in the heating step described above) for drying the treatment liquid attached to the recording medium F and the ink composition attached to the recording medium F. Furthermore, a second feed roller 43 is provided on the downstream side of the platen 34 in the feeding direction Y. The second feed roller 43 is configured such that it is possible to send the recorded recording medium F to the second drying unit 50 on the downstream side in the feeding direction Y.

In addition, the second drying unit 50 is configured so as to be able to further dry the treatment liquid attached to the recording medium F and the ink composition attached to the recording medium F. Although not shown, the second drying unit 50 is provided with a heat transfer mechanism which heats a support unit of which a surface is in contact with the recording medium F and on which the recording medium F is transported on the surface and transfers heat to the recording medium from the support unit. Furthermore, a third feed roller 65 is provided in the vicinity of the outlet 64 of the second drying unit 50. The third feed roller 65 is arranged so as to be in contact with the back surface of the recording medium F and configured to be able to feed the recording medium F to the discharging unit 70 on the downstream side in the feeding direction Y.

Furthermore, the discharging unit 70 is provided so as to be able to further send the recording medium F sent from the second drying unit 50 to the downstream side in the feeding direction Y and discharge the recording medium F to the outside of the ink jet recording apparatus 1. Specifically, the discharging unit 70 has a fourth feed roller 71, a fifth feed roller 72, a sixth feed roller 73, a seventh feed roller 74, and a wind-up roller 75. Among these, the fourth feed roller 71 and the fifth feed roller 72 are arranged so as to contact the surface of the recording medium F. In addition, the sixth feed roller 73 and the seventh feed roller 74 are arranged so as to form a pair of rollers. The recording medium F discharged by the sixth feed roller 73 and the seventh feed roller 74 is provided so as to be wound by the wind-up roller 75.

Figure 2:
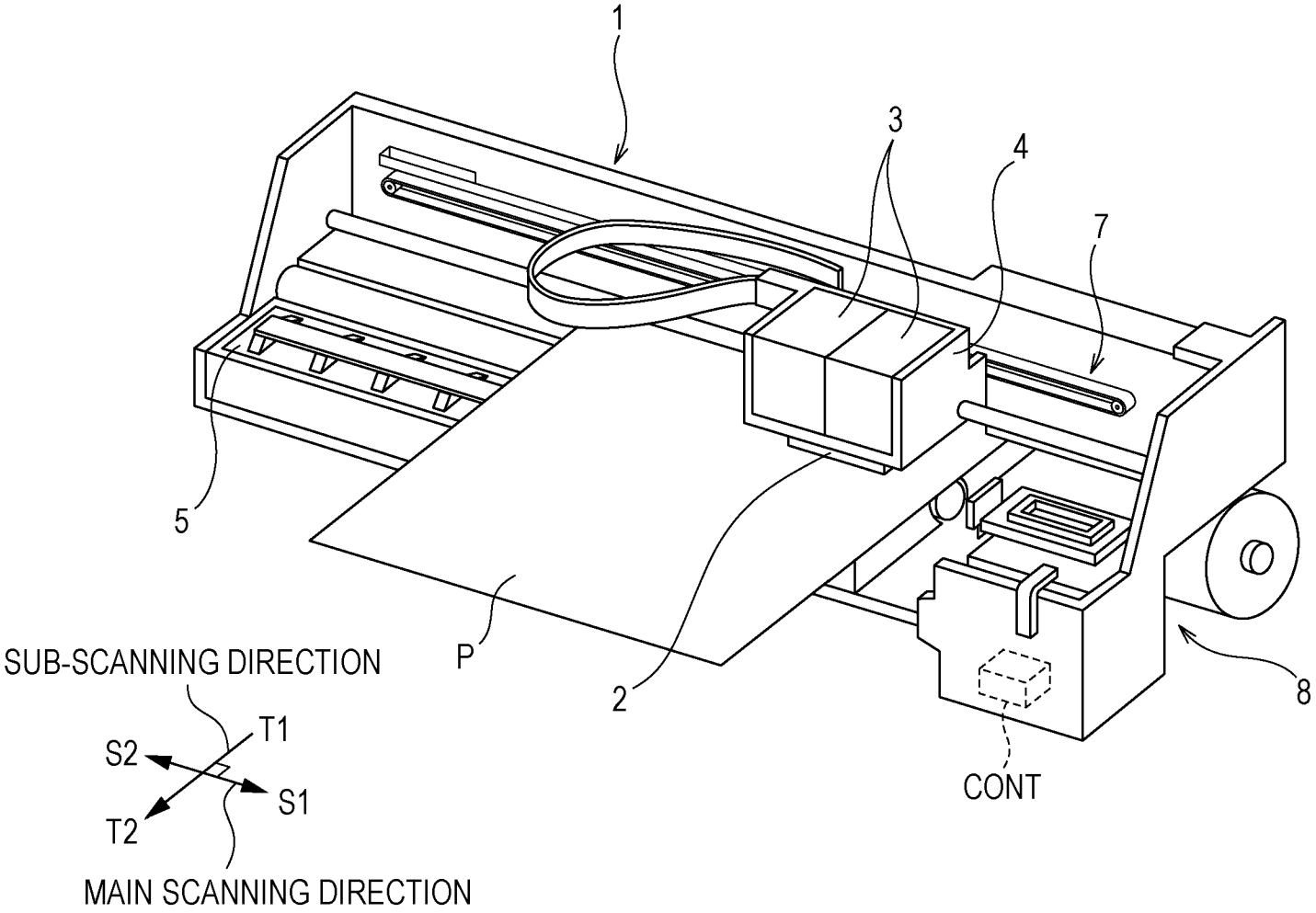
FIG. 2 is a perspective view showing an overall outline of an example of an ink jet recording apparatus able to be used in the present embodiment.

FIG. 2 is a perspective view showing an example of the configuration of the ink jet recording apparatus of the present embodiment which performs recording using the recording method of the present embodiment. The ink jet recording apparatus 1 shown in FIG. 2 has a head 3, a member 2 including a nozzle for ejecting ink, an ink container (not shown), and an ink supply path (not shown) such as an ink supply pipe for supplying ink from the ink container to the head 3. The ink container may be provided at a location other than a carriage 4 or on the carriage.

In addition, the ink jet recording apparatus 1 may have the carriage 4 on which the ink jet head 3 is mounted, a platen 5 arranged below the carriage 4 for transporting the recording medium P, a carriage moving mechanism 7 for relatively moving the carriage 4 with respect to the recording medium P, a medium feeding mechanism 8 which transports the recording medium P in the medium feeding direction, and a control unit CONT which controls the overall operation of the recording apparatus 1.

The ink jet recording apparatus 1 performs recording by performing the main scanning (scanning), in which ink is ejected and attached to an unrecorded medium P while the position of the head 3 relative to the recording medium P is changed in the main scanning direction, a plurality of times. Between one main scanning and another main scanning, the sub-scanning is performed to transport the recording medium P in the sub-scanning direction, and the main scanning and the sub-scanning are alternately performed. In this manner, the ink is sequentially attached on the unrecorded medium P. Such a recording method is also referred to as a multi-pass recording method or a serial recording method.

Figure 3:
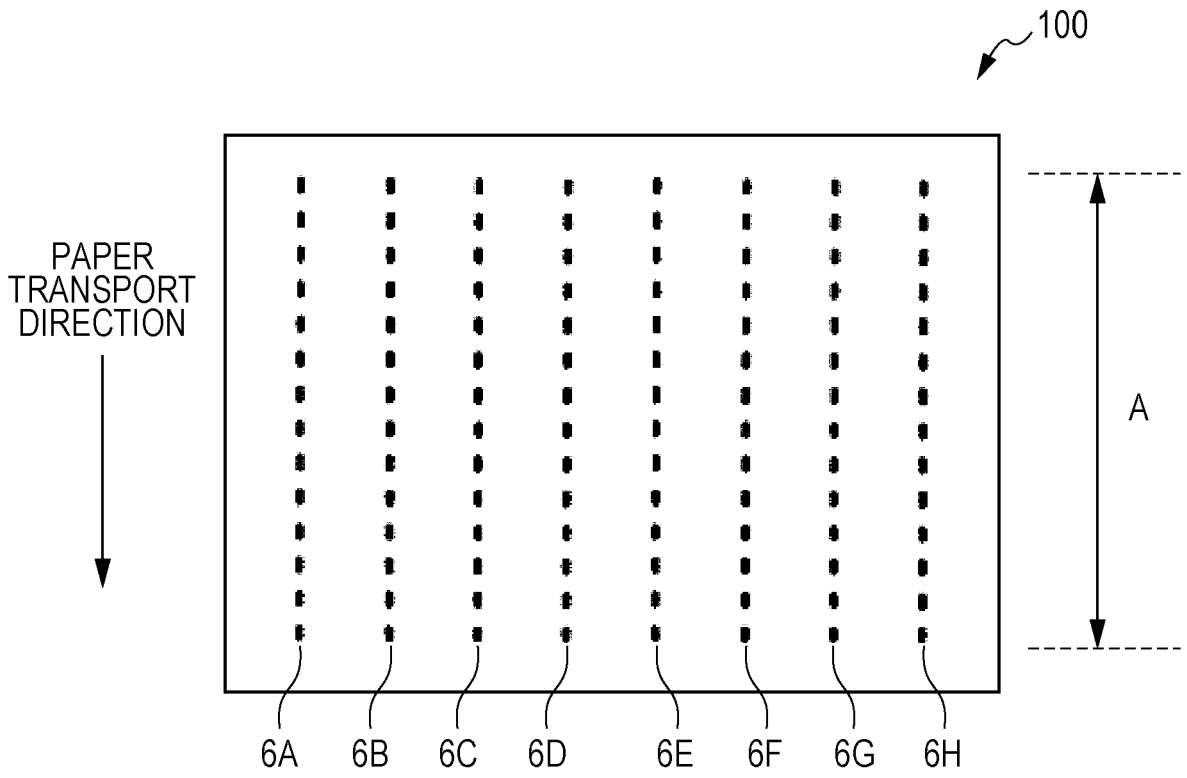
FIG. 3 is a plan view showing an overall outline of an example of a member, which has nozzles, of an ink jet recording apparatus able to be used in the present embodiment.

FIG. 3 is a view of an example of the member 2 including a nozzle for ejecting ink of the ink jet recording apparatus of FIG. 2 as seen from below the member 2 looking upward in FIG. 2. In FIG. 3, the left and right direction is the main scanning direction, and the downward direction of the vertical direction is the sub-scanning direction (paper transport direction). In FIG. 3, a member 100 including nozzles is provided with 8 nozzle groups (nozzle rows) from the left (nozzle groups 6A to 6H) in which a plurality of nozzles are arranged in rows. The member 100 may be a nozzle plate on which a nozzle is formed. The member 100 may be configured such that one type of ink may be ejected from each nozzle of one nozzle group and another kind of ink may be ejected from another nozzle group. The type of ink is, for example, the color of the ink or the like. The plurality of nozzle groups may be arranged side by side in the main scanning direction as shown in FIG. 3 or may be arranged at different positions such as the upstream side and downstream side in the sub-scanning direction as shown in FIG. 1.

In the recording method, the distance the recording medium is transported in one sub-scanning may be the distance of the length A in the sub-scanning direction of one nozzle group, but, in a case where the distance is less than the length A in the sub-scanning direction of one nozzle group, It is possible to allow ink to attach to the same position in the sub-scanning direction of the recording medium a plurality of times in the main scanning, and/or to increase the recording resolution in the sub-scanning direction and the main scanning direction of the recorded matter. These are preferable in terms of being excellent in image quality. By doing so, in the ink composition attaching step, it is possible to allow at least a part of the ink composition ejected onto the recording medium in another main scanning to come into contact with the ink composition attached to the recording medium in a certain main scanning.

EXAMPLES

A more detailed description will be given below of the invention with reference to Examples. The invention is not at all limited by the following Examples.

Materials for Treatment Liquid and Ink Composition

The main materials for the treatment liquid and the ink composition used in the preparation of the recorded matter described below are as follows.

Coloring Material

C.I. Pigment Blue 15:3

Carbon Black (C.I. Pigment Black 7)

Aggregating Agent

Magnesium sulfate hexahydrate (polyvalent metal salt)

Polyallylamine hydrochloride

Succinic acid (organic acid)

Resin (Resin Dispersion)

Polyethylene resin

Styrene-acrylic resin

Organic Solvent 1,2-hexanediol

Dipropylene glycol monomethyl ether 3-butoxy-N,N-dimethylpropionamide 3-methoxy-N,N-dimethylpropionamide 2-pyrrolidone Triethylene glycol monobutyl ether Surfactant BYK 348 (trade name, manufactured by BYK-Chemie) MF 410 (trade name, manufactured by DIC Corporation, perfluoroalkyl group-containing carboxylate surfactant) DW 800 (trade name, manufactured by BYK-Chemie, polyoxyethylene alkyl ether group-containing surfactant) Surfynol DF110D (trade name, manufactured by Nissin Chemical Industry Co., Ltd., acetylene glycol-based)

Water

Pure water

Preparation of Treatment Liquid and Ink Composition

A pigment dispersion is prepared by mixing a pigment and 0.8 parts by mass of a styrene acrylic pigment dispersant resin not described in the table with respect to 1 part by mass of the pigment with water and stirring the result in a bead mill. The pigment dispersion and each of the remaining materials were mixed in the compositions shown in Table 1 below and sufficiently stirred to obtain a treatment liquid and an ink composition. In the following Table 1, the unit of the numerical values is % by mass, and the total is 100.0% by mass.

Surface Tension

As described below, the surface tension of the ink composition and the surface tension of the ink composition when evaporated up to each evaporation amount were measured.

Initial value ("Evaporation amount (% by mass) 0" in the table): the surface tension was measured using a surface tension meter CBVP-Z (trade name, manufactured by Kyowa Interface Science Co., Ltd.) when a platinum plate was wetted with an ink composition in an environment of 25° C.

After evaporation ("Evaporation amount (% by mass) 20", "Evaporation amount (% by mass) 40" in the table): the surface tension was measured at 25° C. in the same manner as described above when the ink composition was allowed to stand at 40° C. and reduced to 20% by mass and 40% by mass with respect to the initial mass (100% by mass). The obtained results are shown in Table 1 together with the difference in surface tension after evaporation from the initial value ("Difference Δ evaporation amount (% by mass) 20" and "Difference Δ evaporation amount (% by mass) 40" in the Table). The absolute value of this difference Δ is the absolute value of the difference in surface tension when the ink composition is evaporated up to each evaporation amount.

The method of measuring the surface tension will be shown specifically as follows. The surface tension of the ink composition was measured at intervals of 5% by mass in the order of 0% by mass, 5% by mass, 10% by mass, 15% by mass, 20% by mass, 25% by mass, 30% by mass, 35% by mass, and 40% by mass at evaporation amounts of 0% to 40% by mass.

In the measurement results of the surface tension of the ink composition obtained in this manner, the largest absolute value of the difference from the surface tension of the ink composition before evaporation during evaporation at evaporation amounts of 0% to 20% by mass was an evaporation amount of 20% by mass. In addition, in the measurement results, the largest absolute value of the difference from the surface tension of the ink composition before evaporation during evaporation at evaporation amounts of 0% to 40% by mass was an evaporation amount of 20% by mass or an evaporation amount of 40% by mass.

Next, using an ink composition of a sample different from the sample measured above, the surface tension of the ink composition was measured at intervals of 1% by mass in the order of 16% by mass, 17% by mass, 18% by mass, 19% by mass, 20% by mass, 21% by mass, 22% by mass, 23% by mass, 24% by mass, 36% by mass, 37% by mass, 38% by mass, 39% by mass, and 40% by mass at evaporation amounts of 16% to 24% by mass and 36% to 40% by mass.

As a result, in the measurement results, the largest absolute value of the difference from the surface tension of the ink composition before evaporation in the evaporation of the ink composition at evaporation amounts of 0% to 20% by mass is an evaporation amount of 20% by mass while the largest absolute value of the difference from the surface tension of the ink composition before evaporation in the evaporation of the ink composition at evaporation amounts of 0% to 40% by mass is an evaporation amount of 20% by mass or 40% by mass, thus, the table shows the surface tension values and the absolute values of the differences in the surface tension at these evaporation amounts.

TABLE 1

| | | Ink Composition | | | | |
|---|---|---|---|---|---|---|
| | | Ink 1 | Ink 2 | Ink 3 | Ink 4 | Ink 5 |
| Coloring material (pigment) | C.I. Pigment Blue 15:3 | 14.00 | 0.00 | 4.00 | 4.00 | 4.00 |
| | Carbon black | 0.00 | 14.00 | 0.00 | 0.00 | 0.00 |
| Resin | Polyethylene resin | 0.55 | 0.55 | 0.55 | 0.55 | 0.55 |
| | Styrene acrylic resin | 3.33 | 3.33 | 3.33 | 5.00 | 5.00 |
| Organic solvent | 1,2-hexanediol | 6.00 | 6.00 | 6.00 | 10.00 | 10.00 |
| | Dipropylene glycol monomethyl ether | 5.00 | 5.00 | 5.00 | 0.00 | 5.00 |
| | 3-butoxy-N,N-dimethylpropionamide | 0.00 | 6.00 | 6.00 | 0.00 | 5.00 |
| | 3-methoxy-N,N-dimethylpropionamide | 6.00 | 0.00 | 0.00 | 10.00 | 0.00 |
| | 2-pyrrolidone | 9.50 | 18.00 | 18.00 | 10.00 | 0.00 |
| Surfactant | BYK348 | 0.80 | 0.80 | 0.80 | 0.00 | 0.00 |
| | MF410 | 0.00 | 0.00 | 0.00 | 0.01 | 0.01 |
| | DW800 | 0.00 | 0.00 | 0.00 | 1.00 | 1.00 |
| | DF110D | 0.40 | 0.40 | 0.40 | 0.40 | 0.40 |
| Water | Pure water | Remainder | Remainder | Remainder | Remainder | Remainder |
| | Total | 100 | 100 | 100 | 100 | 100 |
| Surface Tension (mN/m) | Evaporation amount (% by mass) 0 | 23.6 | 23.7 | 23.8 | 28.7 | 28.5 |
| | Evaporation amount (% by mass) 20 | 24.0 | 24.0 | 24.0 | 29.8 | 29.6 |
| | Difference Δ evaporation amount (% by mass) 20 | 0.4 | 0.3 | 0.2 | 1.1 | 1.1 |
| | Evaporation amount (% by mass) 40 | 24.5 | 24.4 | 24.4 | 29.2 | 29.2 |
| | Difference Δ evaporation amount (% by mass) 40 | 0.9 | 0.7 | 0.6 | 0.5 | 0.7 |

| | | Ink Composition | | | | |
|---|---|---|---|---|---|---|
| | | Ink 6 | Ink 7 | Ink 8 | Ink 9 | Ink 10 |
| Coloring material (pigment) | C.I. Pigment Blue 15:3 | 4.00 | 4.00 | 4.00 | 4.00 | 4.00 |
| | Carbon black | 0.00 | 0.00 | 0.00 | 0.00 | 0.00 |
| Resin | Polyethylene resin | 0.55 | 0.55 | 0.55 | 0.55 | 0.55 |
| | Styrene acrylic resin | 5.00 | 3.33 | 3.33 | 3.33 | 3.33 |
| Organic solvent | 1,2-hexanediol | 0.00 | 6.00 | 6.00 | 6.00 | 6.00 |
| | Dipropylene glycol monomethyl ether | 5.00 | 5.00 | 5.00 | 5.00 | 5.00 |
| | 3-butoxy-N,N-dimethylpropionamide | 0.00 | 6.00 | 12.00 | 6.00 | 3.00 |
| | 3-methoxy-N,N-dimethylpropionamide | 0.00 | 0.00 | 6.00 | 0.00 | 0.00 |
| | 2-pyrrolidone | 5.00 | 18.00 | 0.00 | 18.00 | 6.00 |

TABLE 1-continued

| | | | | | | |
|---|---|---|---|---|---|---|
| Surfactant | BYK348 | 0.00 | 0.00 | 0.80 | 0.80 | 0.80 |
| | MF410 | 0.05 | 0.80 | 0.00 | 0.00 | 0.00 |
| | DW800 | 1.00 | 0.00 | 0.00 | 0.00 | 0.00 |
| | DF110D | 0.00 | 0.40 | 0.40 | 0.00 | 0.40 |
| Water | Pure water | Remainder | Remainder | Remainder | Remainder | Remainder |
| | Total | 100 | 100 | 100 | 100 | 100 |
| Surface Tension (mN/m) | Evaporation amount (% by mass) 0 | 23.3 | 23.0 | 23.2 | 23.5 | 22.9 |
| | Evaporation amount (% by mass) 20 | 22.2 | 22.7 | 23.7 | 24.0 | 23.3 |
| | Difference Δ evaporation amount (% by mass) 20 | −1.1 | −0.3 | 0.5 | 0.5 | 0.4 |
| | Evaporation amount (% by mass) 40 | 22.0 | 22.0 | 23.9 | 24.4 | 23.5 |
| | Difference Δ evaporation amount (% by mass) 40 | −1.3 | −1.0 | 0.7 | 0.9 | 0.6 |

| | Treatment liquid | | |
|---|---|---|---|
| | Treatment liquid 1 | Treatment liquid 2 | Treatment liquid 3 |
| Magnesium sulfate hexahydrate | 3 | — | — |
| Polyallylamine hydrochloride (solid content) | — | 3 | — |
| Succinic acid | — | — | 3 |
| Triethylene glycol monobutyl ether | 10 | 10 | 10 |
| 2-pyrrolidone | 10 | 10 | 10 |
| BYK348 | 0.1 | 0.1 | 0.1 |
| Pure water | Remainder | Remainder | Remainder |
| Total | 100 | 100 | 100 |

Preparation of Recorded Matter

As a heating step, heat transfer means (platen heater) was provided in the platen and it is possible to make the width of the platen longer and to record on a recording medium having a large width, while, as the drying step, an ink jet type printer, which was a modified machine of SC-S80650 (trade name manufactured by Seiko Epson Corporation) provided with heat transfer means (hot plate heater) downstream in the transport direction of the recording medium on the platen, was prepared. Next, the platen heater was set to the primary heating temperature as shown in Table 1 (however, in a case of 25° C., room temperature without heating) and a recording medium (the same material as that of a polyvinyl chloride sheet (trade name manufactured by Sumitomo 3M Ltd "IJ-40") with the width thereof appropriately changed) was sent to the printer. The treatment liquid was filled in the nozzle rows of the recording head on the upstream side of the recording head mounted on the carriage, the ink composition was filled in the nozzle rows of the recording head on the downstream side, and the treatment liquid and the ink composition were continuously recorded in this order.

Here, the attachment amount of the ink composition was 12 mg/inch$^2$. The number of multi-passes and the ejection amount per scan were adjusted such that the attachment amount of the ink composition per scanning (main scanning) was as shown in Table 1. For example, in a case where the attachment amount of the ink composition per scanning was 1.5 mg/inch$^2$, 8-pass recording was performed.

The treatment liquid was attached at the treatment liquid attachment amounts in the table. Recording patterns were recorded by being lined up from one end to the other end of the recording medium with a 3×3 cm square recording pattern.

In the hot plate heater provided as a post-drying step, the recording medium was heated at 80° C. for approximately 1 minute. In addition, recording media of which the widths were changed were prepared, and the time (seconds) for one scanning was changed according to the description in Table 1. For example, in a case where the time of one scanning was 2 seconds, the width of the recording medium was 130 cm, in a case where the time of one scanning was 3 seconds, the width of the recording medium was 180 cm, and in a case where the time of one scanning was 1 second, the width of the recording medium was 90 cm.

Ink Evaporation Amount Between Scannings

At the temperature of the heating step in Table 2, the evaporation amount of the ink composition attached to the recording medium was measured after a time twice as long as one scanning time in Table 2. In the measurement, the reduction ratio of the mass of the ink composition after being left to stand with respect to the mass (100% by mass) of the initial ink composition attached to the recording medium was measured by mass measurement. The obtained results are shown in Table 2. In the present specification, "ink evaporation amount" as used herein is assumed to mean the maximum evaporation amount of the ink composition when the ink composition ejected in the next main scanning comes into contact with the ink attached in a certain main scanning.

Image Quality (Bleeding)

For each recorded matter obtained as described above in "Preparation of Recorded Matter", the recorded pattern was visually observed and image quality (bleeding) was evaluated according to the following evaluation criteria. The obtained results are shown in Table 2.

Evaluation Criteria

A: Unevenness inside the pattern and ink bleeding in the pattern edges were not observed.

B: Unevenness inside the pattern was not observed, but slight bleeding of ink at the pattern edges was observed.

C: Slight unevenness inside the pattern was observed.

D: Unevenness inside the pattern was obvious.

E: Unevenness inside the pattern was obvious, and bleeding of the ink at the pattern edges was also obvious.

Color Difference

For each recorded matter obtained in the above "Preparation of Recorded Matter", colorimetry was performed with a colorimeter for each recording pattern from one end to the other end lined up in the width direction of the recorded matter, the maximum ΔE in the recorded pattern was determined, and the color difference was evaluated according to the following evaluation criteria. The obtained results are shown in Table 2. For colorimetry, the value of L*a*b* specified in CIELAB was measured using a spectrophotometer "Spectrolino" manufactured by Gretag Macbeth Co., Ltd., and the difference (ΔE) between the values was determined.

Evaluation Criteria

A: ΔE is 0.5 or less

B: ΔE is more than 0.5 and 1 or less

C: ΔE is more than 1 and 1.5 or less

D: ΔE is more than 1.5

Ejection Stability

After continuously performing the recording described above "Preparation of Recorded Matter" for 2 hours, the ejection state of the nozzles of the nozzle row filled with the ink composition was visually inspected and the ejection stability was evaluated according to the following evaluation criteria. The obtained results are shown in Table 2. During recording, flushing was performed with a flushing box provided on the side of the platen for each pass.

Evaluation Criteria

A: The number of non-ejecting nozzles is 1% or less

B: The number of non-ejecting nozzles is more than 1% and 3% or less

C: The number of non-ejecting nozzles is more than 3%

Abrasion Resistance

Each recorded matter obtained in the above "Preparation of Recorded Matter" was rubbed 35 times back and forth with a load of 250 g using a friction piece to which a white cotton cloth (in conformity with JIS L 0803) was attached in a Color Fastness Rubbing Tester AB-301 (trade name manufactured by Tester Sangyo Co., Ltd.). Thereafter, peeling of the recorded matter was visually observed, and the abrasion resistance was evaluated according to the following evaluation criteria.

Evaluation Criteria

A: No scratches or peeling of the recording pattern or transfer of ink to the white cotton cloth were observed.

B: Obvious scratches and peeling of the recorded pattern were not observed but transfer of ink to the white cotton cloth was observed.

C: Obvious scratches or peelings were observed in the recorded pattern.

TABLE 2

| | Example 1 | Example 2 | Example 3 | Example 4 | Example 5 | Example 6 |
|---|---|---|---|---|---|---|
| Ink composition | Ink 1 | Ink 2 | Ink 3 | Ink 7 | Ink 8 | Ink 7 |
| Treatment liquid | Treatment liquid 1 | Treatment liquid 1 | Treatment liquid 1 | Treatment liquid 1 | Treatment liquid 1 | Treatment liquid 1 |
| Treatment liquid attachment amount (% by mass) | 10 | 10 | 10 | 10 | 10 | 5 |
| Temperature of heating step (° C.) | 35 | 35 | 35 | 35 | 35 | 35 |
| Scanning time (seconds) | 2 | 2 | 2 | 2 | 2 | 2 |
| Ink attachment amount per scanning (mg/inch$^2$) | 1.5 | 1.5 | 1.5 | 1.5 | 1.5 | 1.5 |
| Ink evaporation amount of main scanning (% by mass) | 40 | 40 | 40 | 40 | 40 | 40 |
| Image quality (bleeding) | B | B | A | B | A | C |
| Color difference | A | A | A | B | A | A |
| Ejection stability | A | A | A | A | B | A |
| Abrasion resistance | B | B | B | B | A | A |

| | Example 7 | Example 8 | Example 9 | Example 10 | Example 11 |
|---|---|---|---|---|---|
| Ink composition | Ink 7 | Ink 7 | Ink 7 | Ink 7 | Ink 7 |
| Treatment liquid | Treatment liquid 1 | Treatment liquid 2 | Treatment liquid 3 | Treatment liquid 1 | Treatment liquid 1 |
| Treatment liquid attachment amount (% by mass) | 20 | 10 | 10 | 10 | 10 |
| Temperature of heating step (° C.) | 35 | 35 | 35 | 40 | 31 |
| Scanning time (seconds) | 2 | 2 | 2 | 2 | 2 |
| Ink attachment amount per scanning (mg/inch$^2$) | 1.5 | 1.5 | 1.5 | 1.5 | 1.5 |
| Ink evaporation amount of main scanning (% by mass) | 40 | 40 | 40 | 47 | 23 |
| Image quality (bleeding) | A | C | C | A | C |
| Color difference | C | A | A | C | A |
| Ejection stability | A | A | A | B | A |
| Abrasion resistance | C | A | B | B | B |

| | Example 12 | Example 13 | Example 14 | Example 15 | Example 16 | Example 17 |
|---|---|---|---|---|---|---|
| Ink composition | Ink 7 | Ink 7 | Ink 7 | Ink 7 | Ink 9 | Ink 10 |
| Treatment liquid | Treatment liquid 1 | Treatment liquid 1 | Treatment liquid 1 | Treatment liquid 1 | Treatment liquid 1 | Treatment liquid 1 |
| Treatment liquid attachment amount (% by mass) | 10 | 10 | 10 | 10 | 10 | 10 |
| Temperature of heating step (° C.) | 35 | 35 | 35 | 35 | 35 | 35 |
| Time for one scanning (seconds) | 1 | 3 | 2 | 2 | 2 | 2 |
| Ink attachment amount per scanning (mg/inch$^2$) | 1.5 | 1.5 | 0.75 | 3 | 1.5 | 1.5 |
| Ink evaporation amount between scannings (% by mass) | 10 | 52 | 40 | 40 | 40 | 40 |
| Image quality (bleeding) | A | C | A | C | A | B |
| Color difference | A | C | A | C | B | B |
| Ejection stability | A | B | A | A | A | A |
| Abrasion resistance | B | B | B | B | B | C |

TABLE 2-continued

| | Example 18 | Example 19 | Comparative Example 1 | Comparative Example 2 | Comparative Example 3 |
|---|---|---|---|---|---|
| Ink composition | Ink 3 | Ink 3 | Ink 4 | Ink 5 | Ink 6 |
| Treatment liquid | — | — | Treatment liquid 1 | Treatment liquid 1 | Treatment liquid 1 |
| Treatment liquid attachment amount (% by mass) | — | — | 10 | 10 | 10 |
| Temperature of heating step (° C.) | 35 | 45 | 35 | 35 | 35 |
| Time for one scanning (seconds) | 2 | 2 | 2 | 2 | 2 |
| Ink attachment amount per scanning (mg/inch$^2$) | 1.5 | 1.5 | 1.5 | 1.5 | 1.5 |
| Ink evaporation amount between scannings (% by mass) | 40 | 50 | 40 | 40 | 40 |
| Image quality (bleeding) | D | C | C | C | D |
| Color difference | B | C | D | D | D |
| Ejection stability | A | C | C | C | C |
| Abrasion resistance | A | A | B | C | C |

As a result of the above evaluation, the following was confirmed.

In all of the Examples, the color difference reduction was excellent due to the provision of a heating step and the use of an ink composition in which the difference of the absolute value between the surface tension of the ink composition and the surface tension of the ink composition when the ink composition is evaporated up to an evaporation amount of 0% to 40% by mass is 1 mN/m or less.

In contrast, in all of the Comparative Examples which were not as above, the color difference reduction was inferior (the color difference was D or E).

In detail, from Examples 3 and 4, in a case where the ink composition includes a silicone-based surfactant or a fluorine-based surfactant, the image quality and color difference reduction were superior and, in a case of including a silicone-based surfactant, particularly excellent.

From a comparison between Example 16 and Example 3, in a case where the ink composition includes a silicone-based surfactant or a fluorine-based surfactant and a polyalkylene oxide alkyl ether-based surfactant or an acetylene glycol-based surfactant, the color difference reduction was superior.

From a comparison between Example 17 and Example 3, the ink composition was excellent in abrasion resistance due to the inclusion of a resin-soluble solvent, and the image quality and color difference reduction were also superior. In addition, from a comparison between Example 5 and Example 3, in a case where a non-cyclic amide solvent was included as the resin-soluble solvent, the abrasion resistance was particularly excellent and, in a case where a cyclic amide solvent was included, the ejection stability was particularly excellent.

From a comparison between Examples 6 and 7 and Example 4, in a case where the attachment amount of the treatment liquid was comparatively small, the color difference reduction and abrasion resistance were superior. In addition, in a case where the attachment amount of the treatment liquid was relatively large, the image quality was superior.

From a comparison between Examples 8 and 9 and Example 4, in a case where the treatment liquid includes a polyvalent metal salt as an aggregating agent, the image quality was particularly excellent, in a case where the treatment liquid includes a cationic resin or an organic acid as an aggregating agent, the color difference reduction was particularly excellent, and in a case of including a cationic resin, the abrasion resistance was superior.

From a comparison between Examples 10 and 11 and Example 4, in a case where the temperature of the heating step was high, the image quality was superior. On the other hand, in a case where the temperature of the heating step was low, the color difference reduction and ejection stability were superior.

From a comparison between Examples 12 and 13 and Example 4, in a case where the scanning time was short, the image quality, color difference reduction, and ejection stability were particularly excellent. On the other hand, in a case where the scanning time was long, the image quality and color difference reduction decreased. From the above, it is determined that the present embodiment is useful in terms of the image quality and color difference reduction being excellent even in a case where the time of one scanning is long and recorded matter with a wide width is obtained.

From a comparison between Examples 14 and 15 and Example 4, the smaller the ink attachment amount in one scanning, the better the image quality and color difference.

From Examples 18 and 19, in a case where the recording method does not have the treatment liquid attaching step, there was a tendency for the image quality to be somewhat lower and, if the temperature of the heating step was increased, there was a tendency for the image quality to be improved but for the color difference reduction to deteriorate, and the ejection stability was also lowered. From the above, it was determined that it is preferable to use the treatment liquid in terms of being able to have a recording method in which the image quality is excellent without increasing the heating temperature.

Comparative Examples 1 to 3 did not use an ink composition in which a difference in absolute value from the surface tension of the ink composition when the ink composition is evaporated up to an evaporation amount of 0% to 40% by mass of 1 mN/m or less, and the color difference reduction was inferior and the image quality was somewhat inferior.

Although not described in the table, when the evaluation was carried out in the same manner as in Example 4 except that the platen heater was turned off and the heating step was not performed, the surface temperature of the recording medium was 25° C. and the ink evaporation amount between scannings was approximately 0% by mass. The image quality evaluation deteriorated to E, but the color difference was A. From the above, it is understood that, even in a case where it is possible to obtain excellent image quality by using the heating step but the color difference reduction is deteriorated, the invention is necessary and useful in terms of being able to obtain an excellent color difference reduction effect.

The entire disclosures of Japanese Patent Application Nos. 2017-210845 filed Oct. 31, 2017 and 2018-146363 filed Aug. 3, 2018 are expressly incorporated by reference herein.

What is claimed is:

1. A recording method comprising:

heating a recording medium; and attaching an ink composition to the heated recording medium by performing main scanning a plurality of times, each main scanning including ejecting the ink composition from a recording head while a position of the recording head relative to the recording medium is changed, wherein the ink composition includes an organic solvent and water, and an absolute value of a difference between an initial surface tension of the ink composition and a subsequent surface tension of the ink composition is 1 mN/m or less, the subsequent surface tension being obtained when the ink composition has evaporated at various evaporation amounts of from 0% to 40% by mass.

2. The recording method according to claim 1, further comprising:

attaching a treatment liquid to the recording medium, the treatment liquid containing an aggregating agent which aggregates components of the ink composition.

3. The recording method according to claim 2, wherein a recording region of the recording medium to which the ink composition and the treatment liquid are attached includes a ratio of 40% by mass or less of the treatment liquid with respect to the ink composition.

4. The recording method according to claim 1, wherein the ink composition further includes a surfactant, and a content of the surfactant is 0.5% by mass or more with respect to a total amount of the ink composition.

5. The recording method according to claim 1, wherein the ink composition further includes a pigment and resin particles.

6. The recording method according to claim 1, wherein the initial surface tension of the ink composition is 28 mN/m or less.

7. The recording method according to claim 1, wherein the recording medium is a low-absorptive recording medium or a non-absorptive recording medium.

8. The recording method according to claim 1, wherein an amount of the ink composition applied to the recording medium per main scanning is 4.0 mg/inch$^2$ or less.

9. The recording method according to claim 1, wherein the main scanning includes a first main scanning and, thereafter, a second main scanning, and wherein at least some of the ink composition ejected onto the recording medium in the second main scanning contacts the ink composition attached to the recording medium in the first main scanning.

10. The recording method according to claim 9, wherein an evaporation amount of the ink composition attached to the recording medium in the first main scanning is 60% by mass or less when the ink composition ejected in the second main scanning comes into contact with the ink composition attached to the recording medium in the first main scanning.

11. The recording method according to claim 1, wherein a duration of each of the main scannings lasts for 1 second or more.

12. The recording method according to claim 1, wherein the ink composition further includes one or more of a silicone-based surfactant and a fluorine-based surfactant, and one or more of a polyoxyalkylene alkyl ether-based surfactant and an acetylene glycol-based surfactant.

13. The recording method according to claim 1, wherein the recording medium has a width in a main scanning direction of 50 cm or more.

14. A recording apparatus comprising:

a heating unit configured to heat a recording medium; and a recording head configured to eject an ink composition to the heated recording medium by performing main scanning a plurality of times, each main scanning including ejecting the ink composition while a position of the recording head relative to the recording medium is changed, wherein the ink composition includes an organic solvent and water, and an absolute value of a difference between an initial surface tension of the ink composition and a subsequent surface tension of the ink composition is 1 mN/m or less, the subsequent surface tension being obtained after up to 40% by mass of the ink composition applied to the recording medium has evaporated.

15. A recording method comprising:

heating a recording medium; and applying an ink composition to the heated recording medium by repeatedly performing main scanning in which the ink composition is ejected from a recording head while a position of the recording head relative to the recording medium is changed, wherein the ink composition includes an organic solvent and water, an absolute value of a difference between a pre-evaporation surface tension of the ink composition and a post-evaporation surface tension of the ink composition is 1 mN/m or less, the post-evaporation surface tension being obtained after up to 40% by mass of the ink composition applied to the recording medium has evaporated, the pre-evaporation surface tension of the ink composition is 15 mN/m or more and 28 mN/m or less, the recording medium is a low-absorptive recording medium or a non-absorptive recording medium, and the main scanning includes a first main scanning and, thereafter, a second main scanning, and at least some of the ink composition ejected onto the recording medium in the second main scanning contacts the ink composition attached to the recording medium in the first main scanning.

16. The recording method according to claim 15, further comprising:

attaching a treatment liquid to the recording medium, the treatment liquid containing an aggregating agent which aggregates components of the ink composition.

17. The recording method according to claim 15, wherein the ink composition further includes a surfactant, and a content of the surfactant is 0.5% by mass or more with respect to a total amount of the ink composition.

18. The recording method according to claim 15, wherein an amount of the ink composition applied to the recording medium per main scanning is 4.0 mg/inch$^2$ or less.

19. The recording method according to claim 15, wherein a duration of each main scanning lasts for 1 second or more.

20. The recording method according to claim 15, wherein the recording medium has a width in a main scanning direction of 50 cm or more.

* * * * *